US006946592B1

(12) United States Patent
Chick

(10) Patent No.: US 6,946,592 B1
(45) Date of Patent: Sep. 20, 2005

(54) PLECTRUM FOR A STRING INSTRUMENT, A TRANSMITTER/RECEIVER ARRANGEMENT AND A SIGNAL PROCESSING APPARATUS

(75) Inventor: Steve Chick, Kensington (AU)

(73) Assignee: Steve Chick Research Pty Ltd., Kensington (AU)

( * ) Notice: Subject to any disclaimer, the term of this patent is extended or adjusted under 35 U.S.C. 154(b) by 273 days.

(21) Appl. No.: 10/019,984

(22) PCT Filed: Jul. 5, 2000

(86) PCT No.: PCT/AU00/00808

§ 371 (c)(1),
(2), (4) Date: May 31, 2002

(87) PCT Pub. No.: WO01/03107

PCT Pub. Date: Jan. 11, 2001

(30) Foreign Application Priority Data

Jul. 6, 1999 (AU) ..... PQ1446

(51) Int. Cl.[7] ..... G10D 3/16
(52) U.S. Cl. ..... 84/322; 84/626; 84/737
(58) Field of Search ..... 84/737–746, 320–322, 84/626, 615, 621, 662, 691, 723

(56) References Cited

U.S. PATENT DOCUMENTS 3,290,425 A * 12/1966 Stobaugh ..... 84/741
3,530,227 A * 9/1970 Wheeler et al. ..... 84/722
3,825,666 A * 7/1974 Jaggers ..... 84/672
3,901,118 A * 8/1975 Ford ..... 84/723
4,064,781 A * 12/1977 Fals ..... 84/322
4,235,144 A 11/1980 Lubow et al.
5,025,704 A * 6/1991 Davis ..... 84/723
5,300,730 A 4/1994 Ekhaus
5,449,858 A * 9/1995 Menning et al. ..... 84/727
5,693,904 A * 12/1997 Kihneman et al. ..... 84/725
5,698,808 A * 12/1997 Hamlin ..... 84/722
5,700,966 A * 12/1997 LaMarra ..... 84/645
5,864,083 A 1/1999 Caren

* cited by examiner

*Primary Examiner*—Marlon T. Fletcher
*Assistant Examiner*—David S. Warren
(74) *Attorney, Agent, or Firm*—Webb Ziesenheim Logsdon Orkin & Hanson, P.C.

(57) ABSTRACT

A plectrum for a stringed musical instrument having a plurality of conductive strings is provided with a non-conductive body and a conductive tip. The conductive tip is sized so as to fleetingly contact a string when the string is plucked with a plectrum. The tip is electrically connected to a monitoring circuitry which provides a triggering signal each time the tip contacts any of the strings. A transmitter and receiver arrangement is provided to monitor the contact of the tip with the strings and generate the triggering signal. The triggering signal is in turn received by a signal processing apparatus which modifies the audio signal output from the stringed musical instrument under control of the triggering signal.

30 Claims, 22 Drawing Sheets

Fig 1
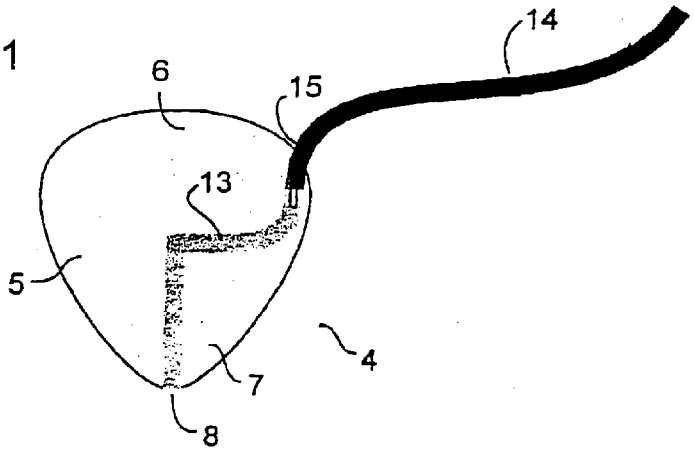
Fig 3
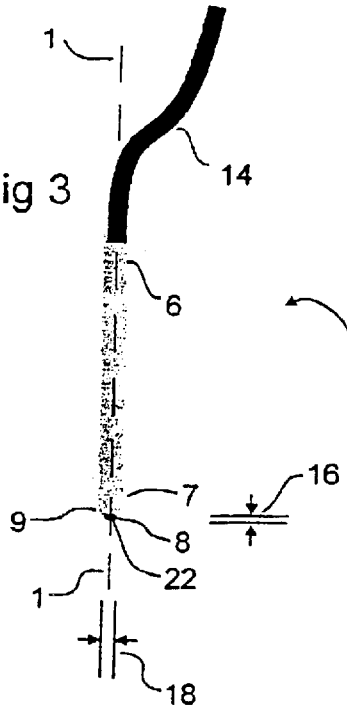
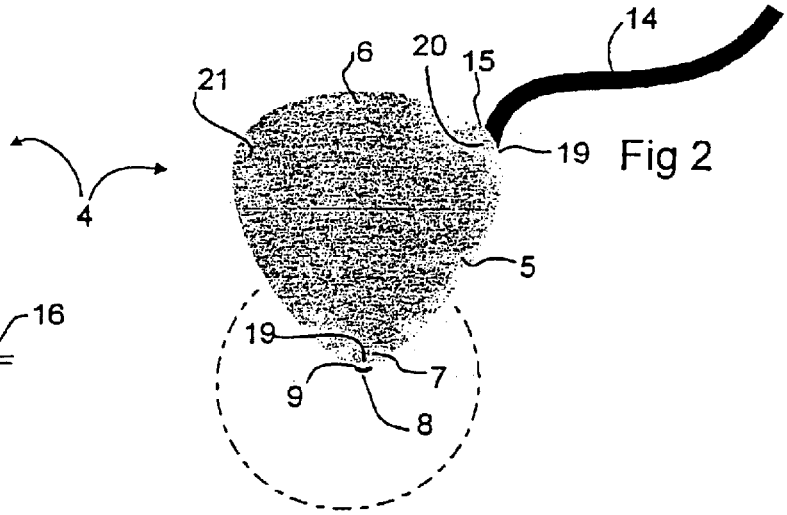
Fig 2
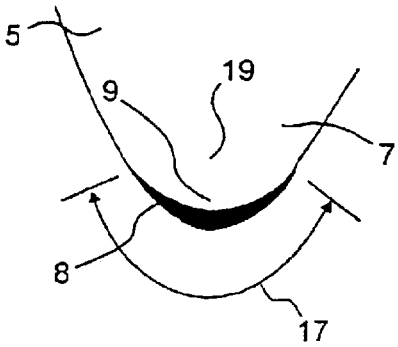
Fig 2A

Fig 11 SIGNAL A
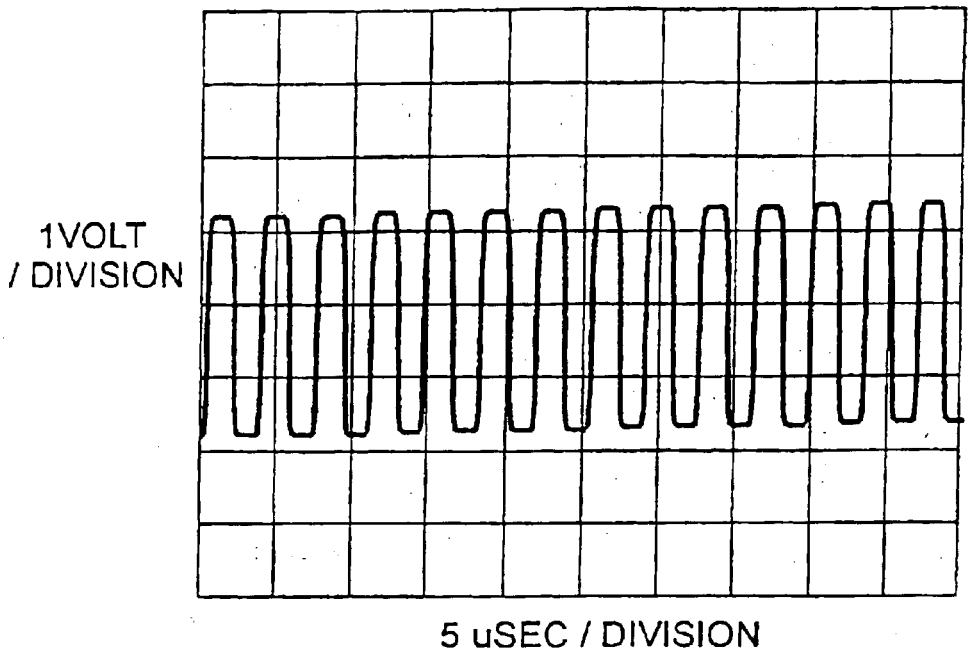
Fig 12 SIGNAL B
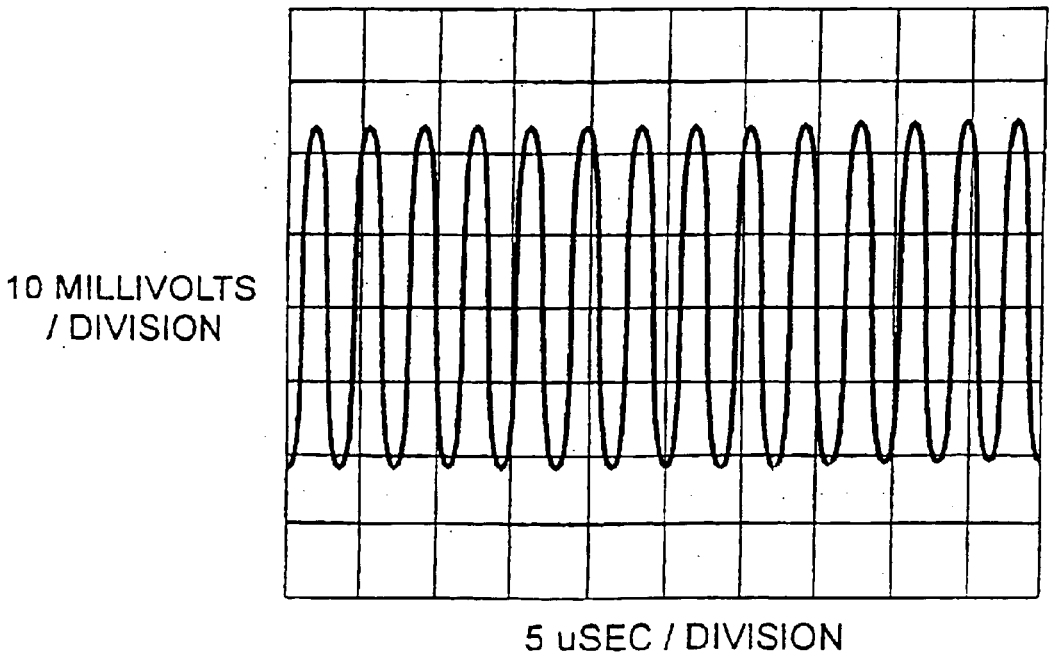

Fig 13 SIGNAL C
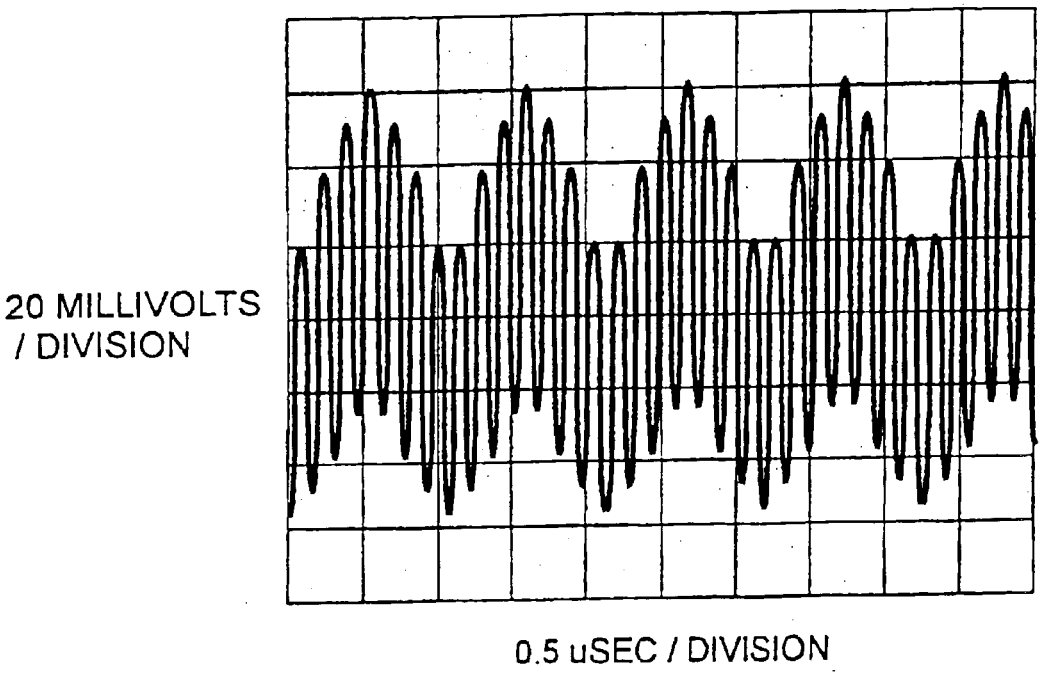
Fig 14 SIGNAL D
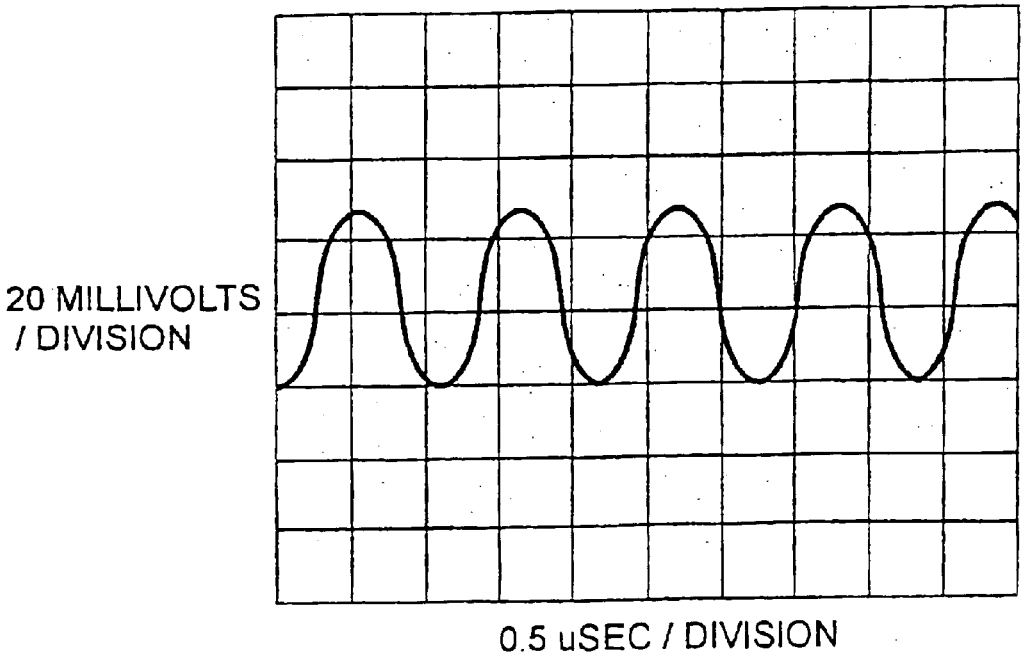

PLECTRUM FOR A STRING INSTRUMENT, A TRANSMITTER/RECEIVER ARRANGEMENT AND A SIGNAL PROCESSING APPARATUS

FIELD OF THE INVENTION

The present invention relates to string instruments having a plurality of conductive strings, for example electric guitars. In particular, the present invention relates to a plectrum for use with such string instruments, a transmitter/receiver arrangement adapted for use with the plectrum and a signal processing apparatus also adapted for use with the plectrum.

The invention has been developed primarily for use in digital processing of the audio output from a string instrument and will be described hereinafter with reference to this application. However, it will be appreciated that the invention is not limited to this particular field of use. For example, the triggering signal derived from the present invention can also be used to drive effects other than audio effects, for example lighting effects being synchronised with music played upon the string instrument.

BACKGROUND TO THE INVENTION

Known techniques for processing an audio signal derived from string instruments are limited by the difficulty of providing an accurate triggering signal to enable event-driven signal processing techniques. Accordingly, most signal processing techniques currently used in real-time with string instruments are continuous in the sense that a signal processing process is not stopped and started on an event basis. Typical audio effect processes such as echo, reverberation, phasing, panning, chorus and flanging are usually continuous in nature since the effect is applied to the audio signal continuously for as long as the effect is desired.

An attempt to provide a triggering signal to enable more sophisticated signal processing is described in U.S. Pat. No. 4,235.144. This prior art document discloses a conductive pick connected to a contact sensor which senses conductive contact between the strings of the guitar and the conductive pick. In this arrangement, breaking contact between the pick and the string initiates a special musical effect.

It has been appreciated by the inventor of the present invention however that this prior art arrangement suffers numerous technical defects to the extent that it cannot be successfully employed to provide a triggering signal reliable enough to enable sophisticated event-driven signal processing. In particular, the inventor of the present invention has discovered that the conductive contact between the string and the prior art conductive pick can be subject to numerous imperfections leading to false triggering. This can be exacerbated by the habit of some string instrument players of resting their pick on the string before actually plucking the string. As the prior art arrangement triggers from the moment when conductive contact between the pick and the string is broken, the imperfect conductive connection can result in false triggering. Other factors leading to imperfect triggering by the prior art arrangement of U.S. Pat. No. 4,235,144 include: a string and/or the pick may be tamished, thereby inhibiting stable conductive contact; the pressure of the pick on the string may not be constant due to the player touching the pick against the string lightly; and larger gauge strings in particular can be vibrating quite vigorously towards and away from the pick, thereby initiating and breaking conductive contact prior to plucking of the string. Whilst this imperfect triggering may suffice for the relatively simple effects outlined in the abovementioned U.S. patent, it has been found by the inventor of the present application not to suffice for slightly more sophisticated triggering such as MIDI triggering, Control Voltage and Gate triggering, in other words, the type of triggering required for the signal processing provided by modern synthesizers.

OBJECT OF THE INVENTION

It is an object of the present invention to overcome or ameliorate at least one of the disadvantages of the prior art, or to provide a useful alternative.

SUMMARY OF THE INVENTION

According to a first aspect of the invention there is provided a plectrum for a string instrument having a plurality of conductive strings, said plectrum including:

a non-conductive body defining a gripping portion and a plucking portion; and a conductive tip protruding just beyond an edge of said plucking portion, an outer surface of said tip being sized so as to fleetingly contact a string of said instrument when said string is plucked by said plucking portion, said tip further being capable of operative association with electronic monitoring circuitry adapted to provide a triggering signal each time the tip contacts any one of said strings.

Preferably the tip is electrically connected to a first wire embedded within the body which is, in turn, electrically connected to a second wire external of the body and extending from a point on the body remote of the plucking portion.

In the preferred embodiment the tip protrudes from an outer edge of the plucking portion by no more than 1 mm and the perimeter length of the tip is no greater than 8 mm.

According to a second aspect of the invention there is provided a transmitter/receiver arrangement adapted for use with a plectrum as described above, said arrangement including a transmitter having a signal generator electrically connectable to said tip such that, when said tip fleetingly connects with said string during plucking, the transmitter produces a signal which is detectable by receiver circuitry, said receiver circuitry being operatively associated with said electronic monitoring circuitry so as to provide said triggering signal.

Preferably the transmitter is mountable to a person playing the instrument, for example by means of a strap mounted to the wrist of the person. The transmitter is preferably electrically connectable to the plectrum by the second wire.

According to a third aspect of the invention there is provided a transmitter adapted for use with a plectrum as described above, said transmitter having a radio frequency signal generator electrically connectable to said tip such that, when said tip fleetingly connects with said string during plucking, the tip injects a radio frequency signal into the string.

According to a fourth aspect of the invention there is provided a receiver adapted for use with the transmitter as described above including receiver circuitry being tuned to said radio frequency so as to detect the radio frequency signal injected into the string, the receiver being operatively associated with said electronic monitoring circuitry so as to provide said triggering signal.

According to another aspect of the invention there is provided a signal processing apparatus adapted to process an audio signal derived from a string instrument having a plurality of conductive strings being plucked by the plectrum described above, said apparatus including:

a first input to receive said audio signal;

a second input to receive a triggering signal which includes a plurality of triggering pulses, each indicative of a plucking of any of said strings by said plectrum tip;

signal processing circuitry adapted to perform a plurality of different processes, each process modifying the audio signal, said circuitry being electrically connected to said first and second inputs, and wherein said signal processing circuitry is adapted to vary the particular process used to modify the audio signal according to a predefined relationship with said triggering signal; and an output electrically connected to said signal processing circuitry for outputting a modified audio signal.

In one preferred embodiment the predefined relationship is such that the process is varied each time an integral number of triggering pulses are received. For example, this integral number may be 1, in other words the process applied to the audio signal is varied each time a triggering pulse is received.

BRIEF DESCRIPTION OF THE DRAWINGS

A preferred embodiment of the invention will now be described, by way of example only with reference to the accompanying drawings in which:

FIG. 1 is a cross-sectional view of a plectrum according to the invention taken through Line 1—1 of FIG. 3;

FIG. 2 is a plan view of the plectrum shown in FIG. 1;

FIG. 2*a* is an exploded view of the tip shown within the dotted region of FIG. 2;

FIG. 3 is a side view of the plectrum shown in FIG. 1;

FIGS. 11 to 15 inclusive are waveform diagrams showing various signals associated with the transmitter/receiver arrangement of the present invention:

DETAILED DESCRIPTION OF THE PREFERRED EMBODIMENTS

Figure 4:
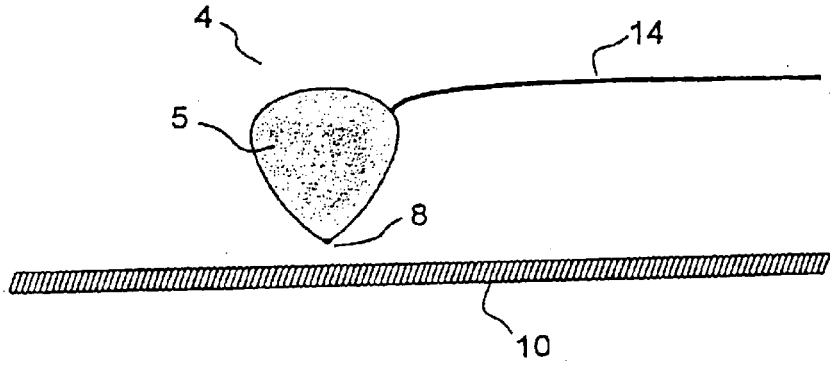
FIG. 4 is a plan view of the plectrum shown in FIG. 1, along with a string of an instrument.

Referring to the drawings, the plectrum 4 shown in FIGS. 1 to 5 includes a non-conductive body 5 having a gripping portion 6 and a plucking portion 7. The body 5 is constructed of a plastics material in the preferred embodiment. A conductive tip 8 protrudes just beyond an edge 9 of the plucking portion 7. The outer surface of the tip 8 is sized so as to fleetingly contact a string 10 of the instrument 11 as the string 10 is plucked by the plucking portion 7. This is best shown in the progressive plucking action illustrated in FIG. 5. In particular, contact between the tip 8 and the string 10 occurs at step D of FIG. 5. The tip 8 is capable of operative association with electronic monitoring circuitry 12, an embodiment of which is shown in FIG. 10. The details of the operative association between the tip 8 and the electronic monitoring circuitry 12 will be described in more detail later in this document. The electronic monitoring circuitry 12 is adapted to provide a triggering signal shown as signal G in FIG. 15 each time the tip 8 contacts any of the strings 10 of the instrument 11.

This inventive arrangement has been found to provide far more reliable triggering than that provided by the prior art. Additionally, because the tip 8 only contacts the string 10 during the instant of plucking, it is possible for the electronic monitoring circuitry 12 to monitor for any moment that conductive contact between the tip 8 and the wire 10 is made, rather than monitoring for the moment when conductive contact is broken, as in the prior art.

Figure 5:
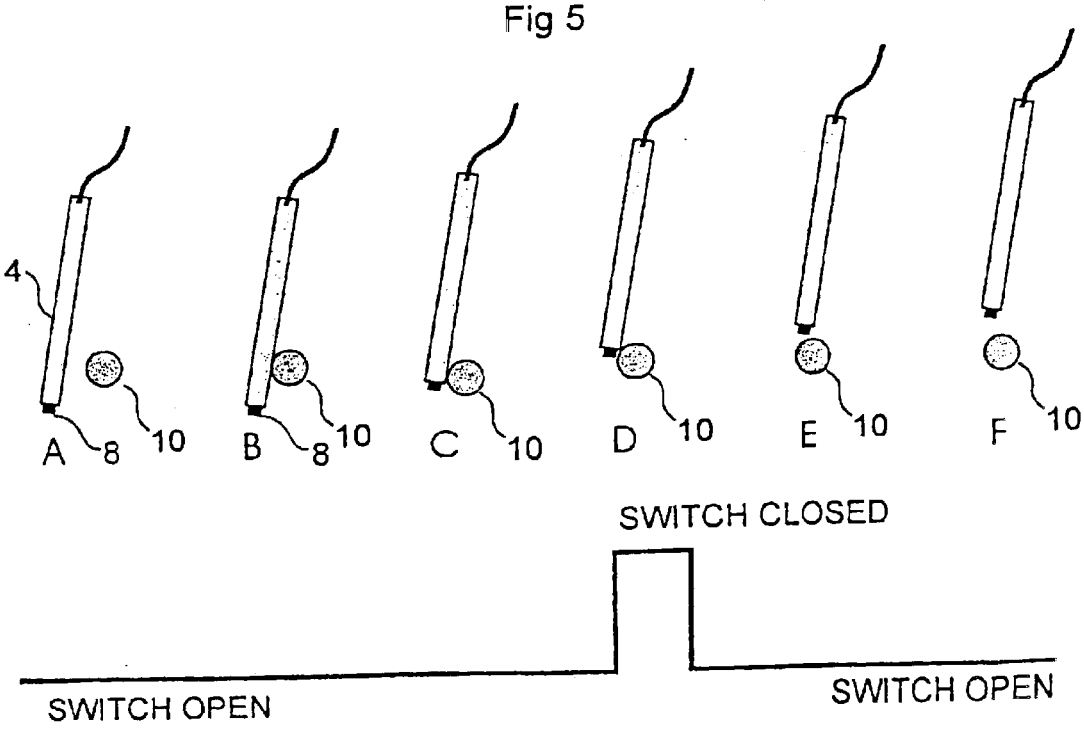
FIG. 5 is a progressive view of a plectrum according to the present invention plucking a string on an instrument, along a pulse arising from said plucking action.

The geometry of the non-conductive body 5 and the barely exposed tip 8 is such that a player can rest the plectrum against a string, as shown in views B and C of FIG. 5 prior to plucking without the tip 8 contacting the string 10, and therefore without causing any false triggering. Additionally, as the electronic monitoring circuitry 12 of the preferred embodiment monitors for the instant that conductive contact is made, rather than broken, it is possible for the arrangement of the present invention to provide a triggering signal wherein each triggering pulse is initiated an instantaneous moment before a string 10 is actually plucked. This advantageously effectively provides a lead time which can be offset against any lag time that may exist in the audio signal processing apparatus to help ensure that the audio signal processing apparatus is in a required state prior to, or at the moment of, receiving the audio input resulting from the plucking of the string.

The tip 8 is electrically connected to a first wire 13 which may be embedded within the body 5. In other embodiments (not illustrated), the tip 8 is an integral part of the wire 13. The first wire 13 is, in turn, electrically connected to a second wire 14 external of the body 5. The second wire 14 extends from a point 15 of the body 5 remote of the plucking portion 7.

In one embodiment the first and second wires 13 and 14 are formed from a preshrunk polyester (not illustrated) upon which silver conductive ink is screen printed to provide a conductive surface. This advantageously provides a strong conductor which is sufficiently thin to be embedded within the body 5, or applied thereto as a surface coating. Additionally, the pre-shrunk polyester can be manufactured with a width which can be attached to the plectrum 4 such that the width is aligned with the body 5. This provides ergonomic advantages by contributing to freedom of movement of the plectrum. The width is preferably between 2 mm and 8 mm, and in the preferred embodiment is approximately 3.5 mm.

The tip 8 preferably protrudes from the outer edge 9 of the plucking portion 7 by no more than 1 mm. In the preferred embodiment, the distance by which the tip 8 protrudes is 0.5 mm. This dimension can be best appreciated with reference to FIG. 3 and in particular to the perpendicular distance separating lines 16 marked thereon. In the preferred embodiment the perimeter length of the tip 8 is no greater than 8 mm and the dimension used in the preferred embodiment is 2 mm. This dimension can be best appreciated from FIG. 2*a*, and in particular from the distance separating lines 17 marked thereon. The width of the tip 8 is preferably no greater than the width of the pick and in the preferred embodiment is 0.5mm. This can be best seen with reference to FIG. 3 and in particular to the perpendicular distance separating lines 18 marked thereon. This dimension is less than the corresponding width of the body 5. An outer edge 22 of the tip 8 is shaped to generally correspond to the shape of the outer edge of the plucking region 7 from which the tip 8 extends.

As best shown in FIG. 2, the body 5 of the plectrum 4 is generally a triangular shape. The region adjacent first apex 19 defines the plucking portion 7 and the tip 8 is disposed at the first apex 19. The second wire 14 extends from, or adjacent to, one of the other apexes, in this case, apex 20. In other embodiments, the second wire 14 extends from other regions of the body 5 of the plectrum 4. The region adjacent apexes 20 and 21 defines the gripping portion 6.

The electronic monitoring circuitry 12 is adapted to detect the initiation of conductive contact between the tip 8 and the string 10 and to use said contact as the basis for the triggering signal. The switch which is effectively formed by the plectrum 4 and the string 10 is shown in an open state in FIG. 4.

Figure 6:
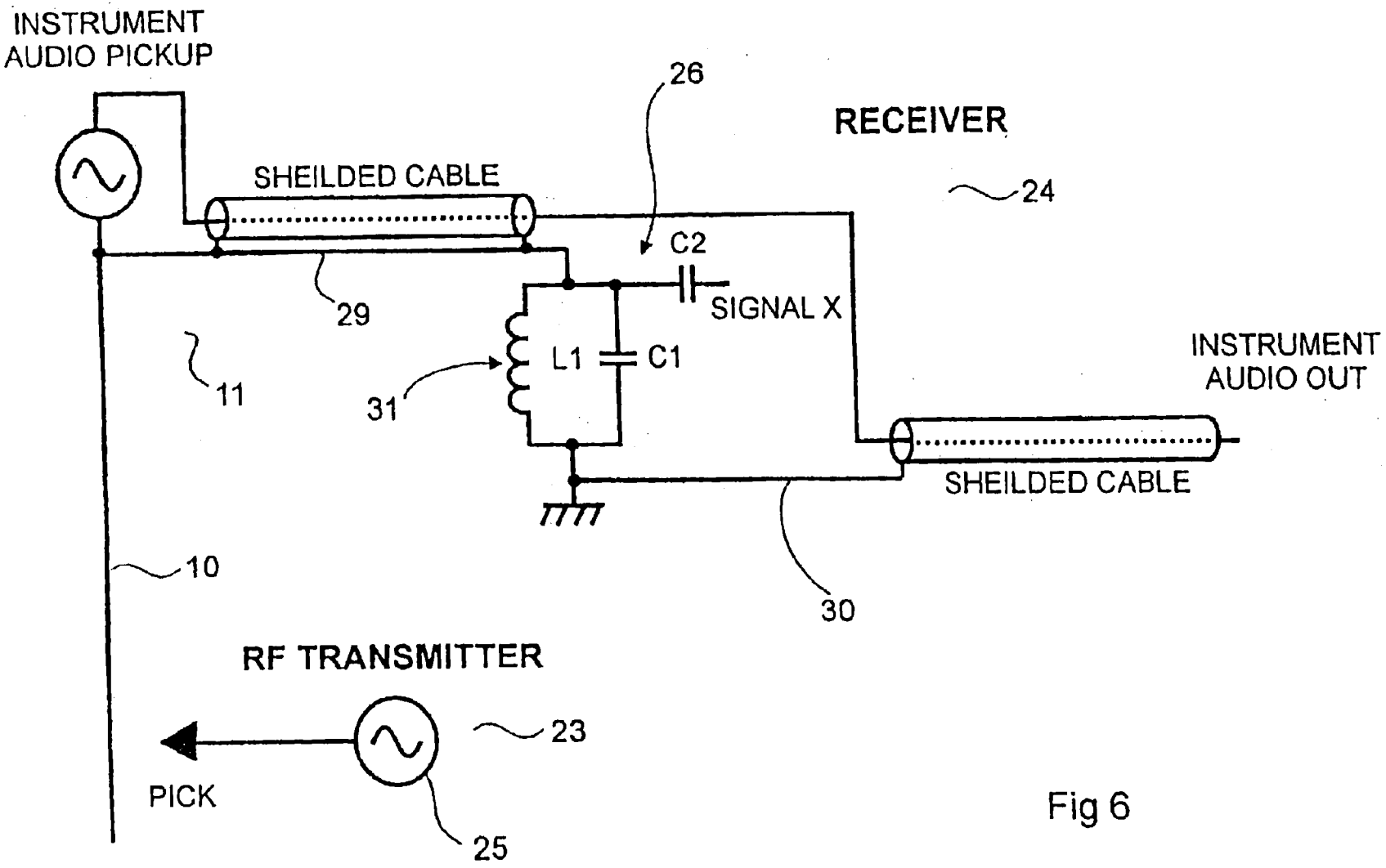
FIG. 6 is a schematic view of a transmitter/receiver arrangement according to the present invention and its relationship to a string instrument.
Figure 7:
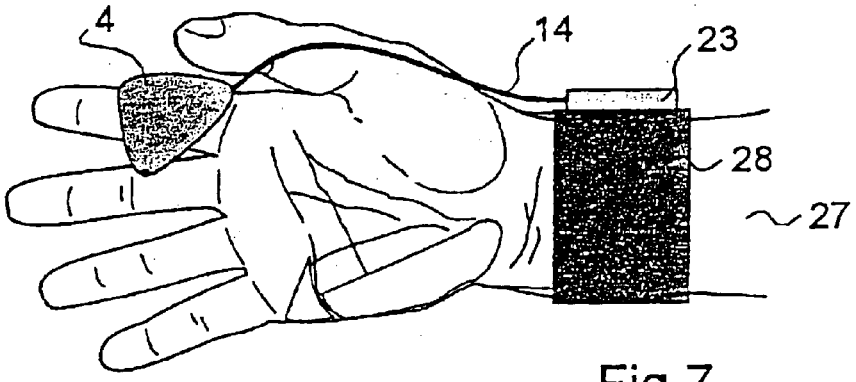
FIG. 7 is a plan view of a transmitter mounted to the wrist of a user, said transmitter being electrically connected to a plectrum according to the invention.

FIG. 6 depicts a schematic representation of the transmitter 23, a receiver 24 and a preferred embodiment of a transmitter/receiver arrangement whereby said transmitter 23 communicates to said receiver 24. The transmitter 23 includes a signal generator 25 which is electrically connectable to the tip 8. In one embodiment, the tip 8 is connected to a radio frequency signal generator 25 via the first and second wires, the second wire terminating in a plug which is mateable with a socket provided upon the transmitter 23. When the tip 8 fleetingly connects with the string 10 during plucking, as shown in FIG. 5, the tip 8 injects a radio frequency signal shown as signal A in FIG. 11 into the string 10. The radio frequency signal (signal A) is detectable by receiver circuitry 26 which is tuned to the signal. The receiver 24 is operatively associated with electronic monitoring circuitry 12 so as to provide the triggering signal (signal G).

In another embodiment (not illustrated), the electrical connection between the tip 8 and the transmitter 23 is achieved by means of capacitive coupling. It will be appreciated by those skilled in the art that other methods of electrical connection may also be used.

In the illustrated preferred embodiment the transmitter 23 is mountable to a person 27 playing the instrument 11. In particular, the transmitter 23 is disposed upon, or housed within, a strap 28 mountable to a wrist of the person 27. The strap of the preferred embodiment is held in place by hook and eye fasteners (also known as "velcro"), although clearly other fastening means may be employed. The strap 28 includes means to house or mount a battery (not illustrated) to power the radio frequency signal generator 25. This allows the player 27 of the instrument 11 greater freedom of movement as compared to having the plectrum 4 hard wired to circuitry win the receiver which would require a long cable from the plectrum to the receiver.

Figure 9A:
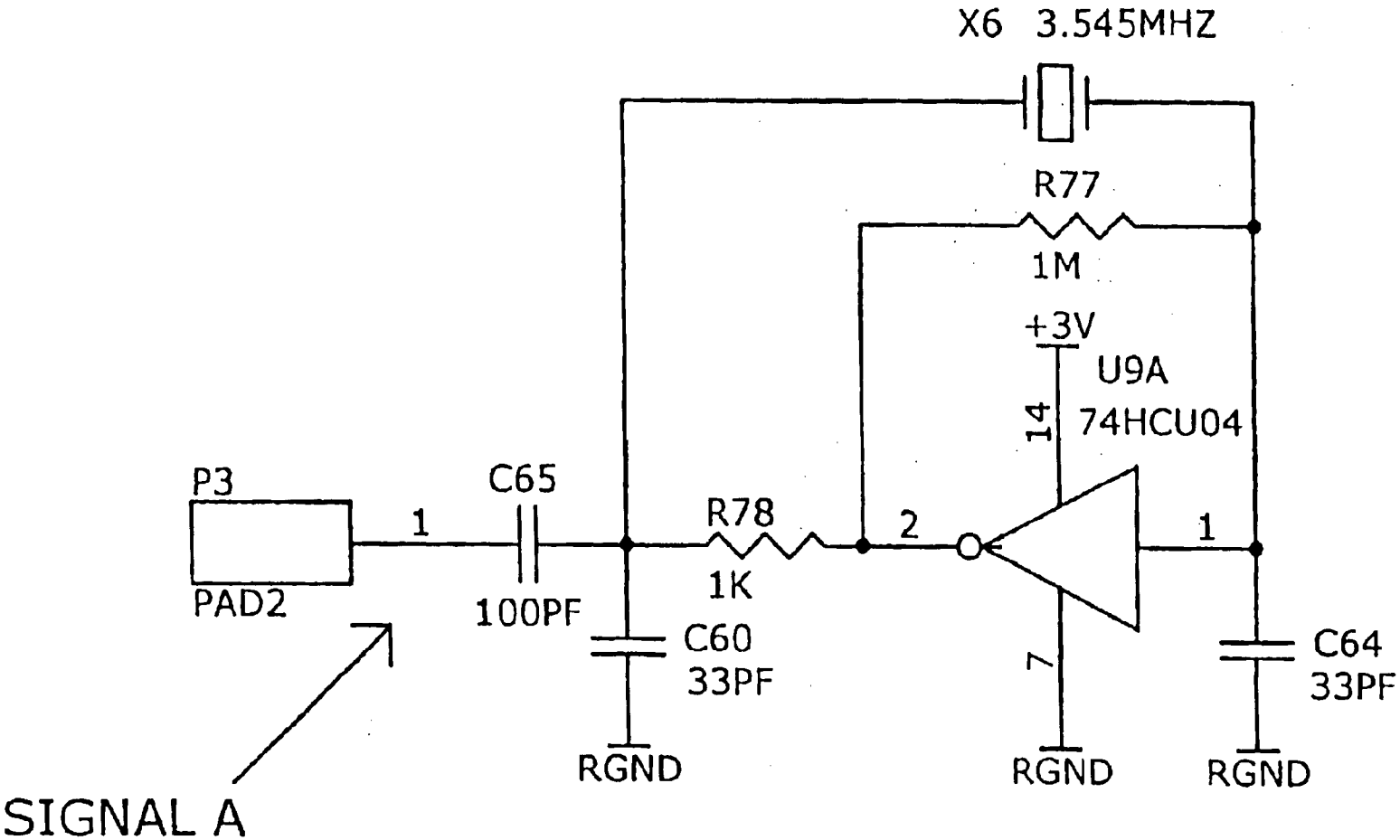
FIG. 9 is a circuit diagram showing circuitry included in a transmitter according to the present invention.
Figure 9B:
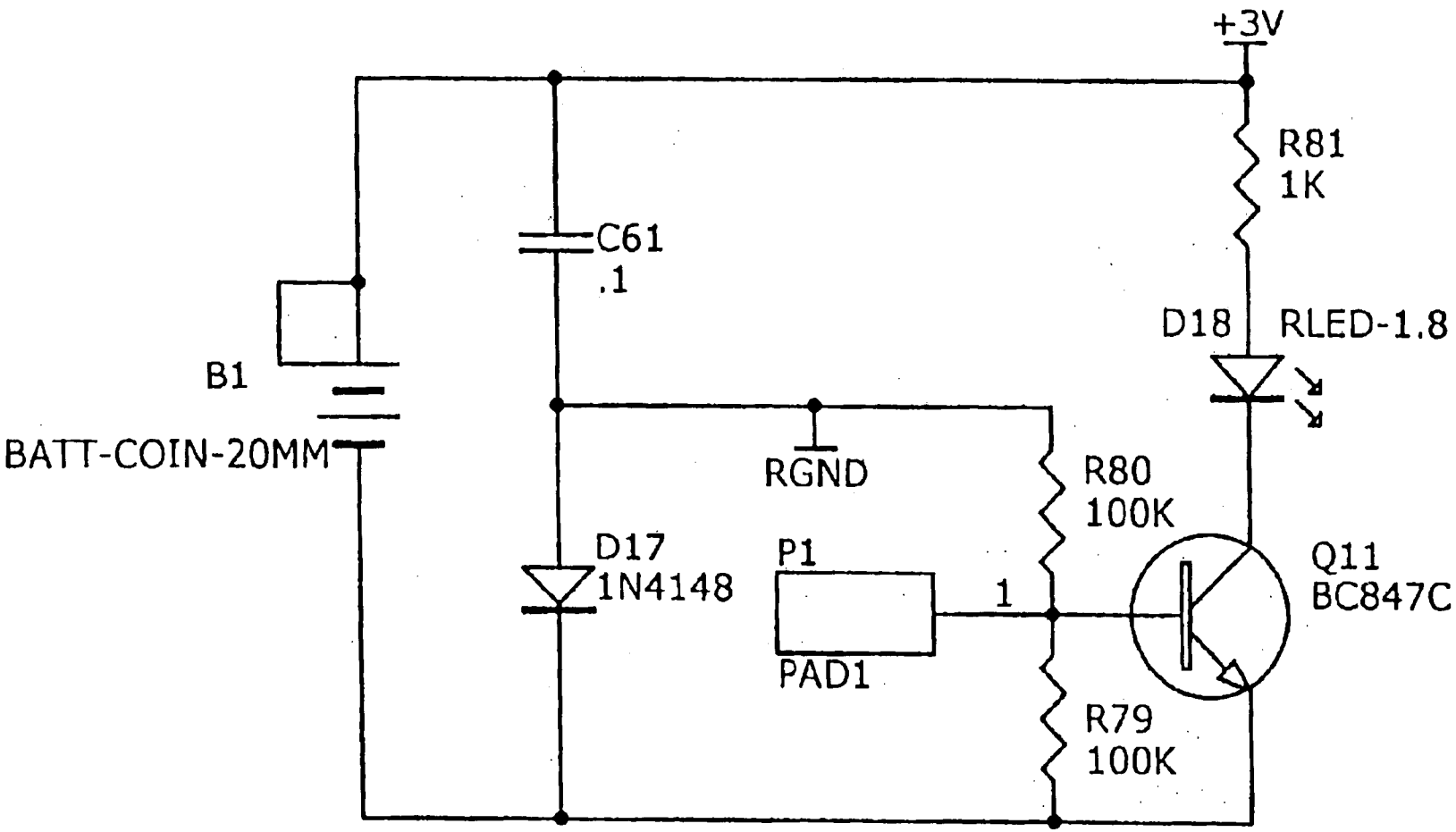
Figure 10A:
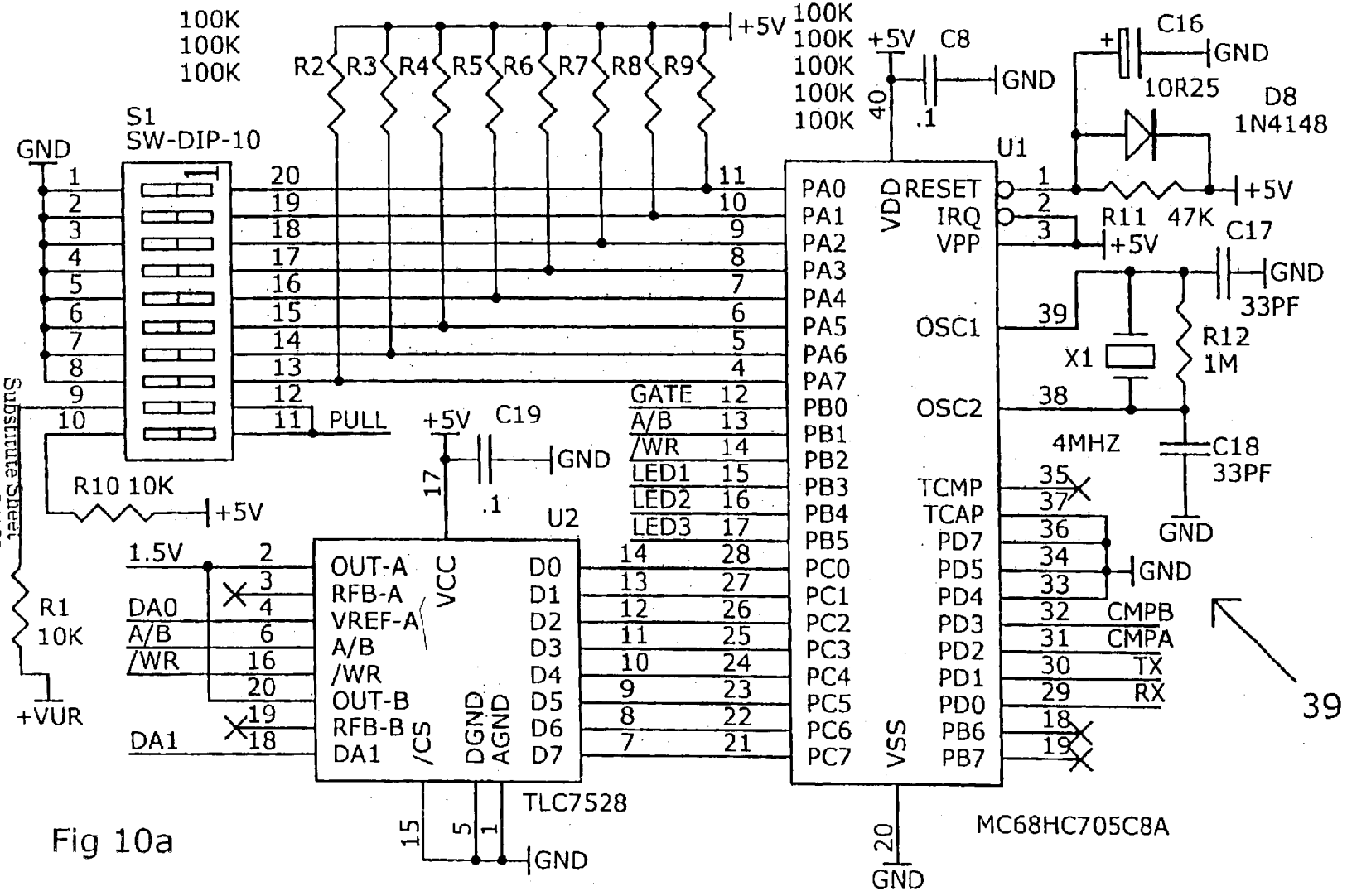
FIG. 10 is a circuit diagram showing circuitry included in a receiver according to the present invention.
Figure 10B:
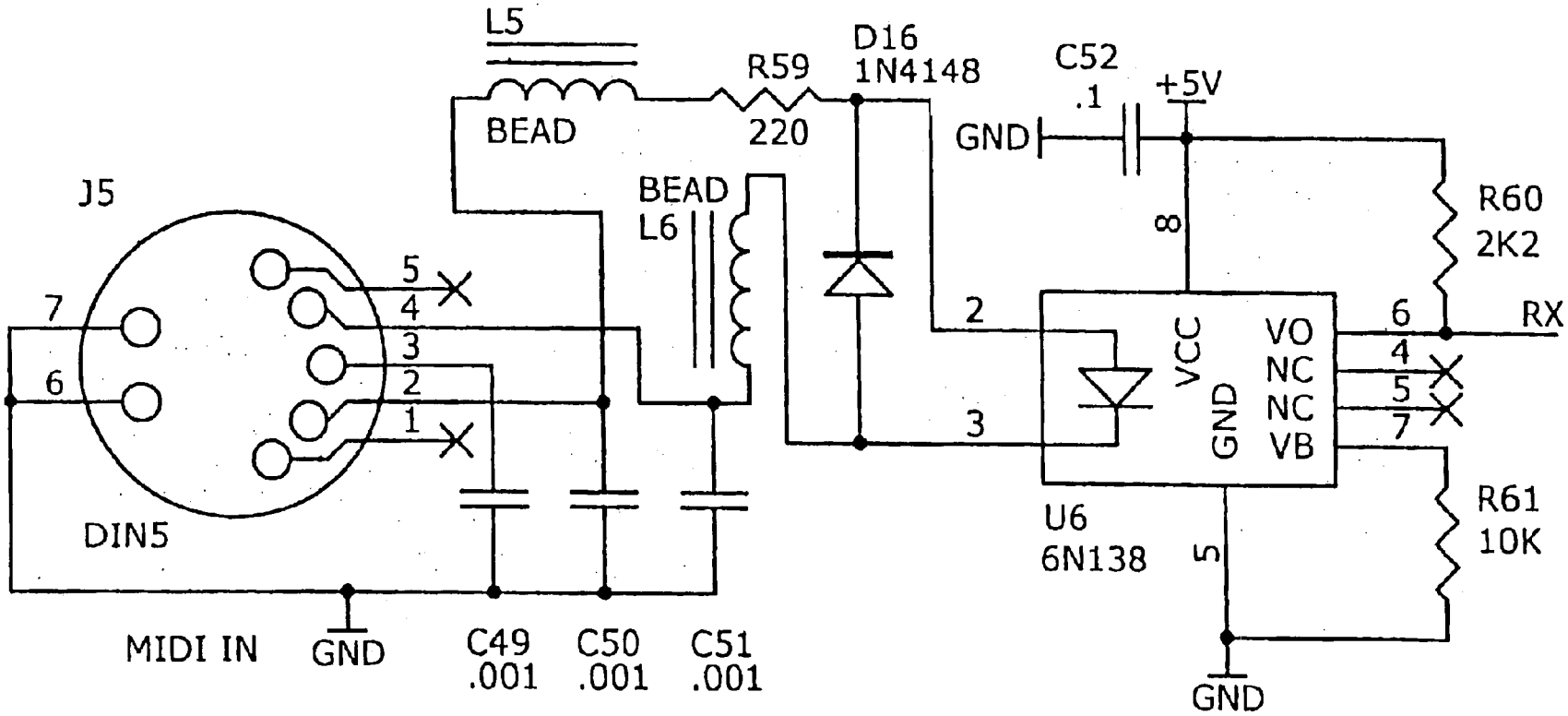
Figure 10C:
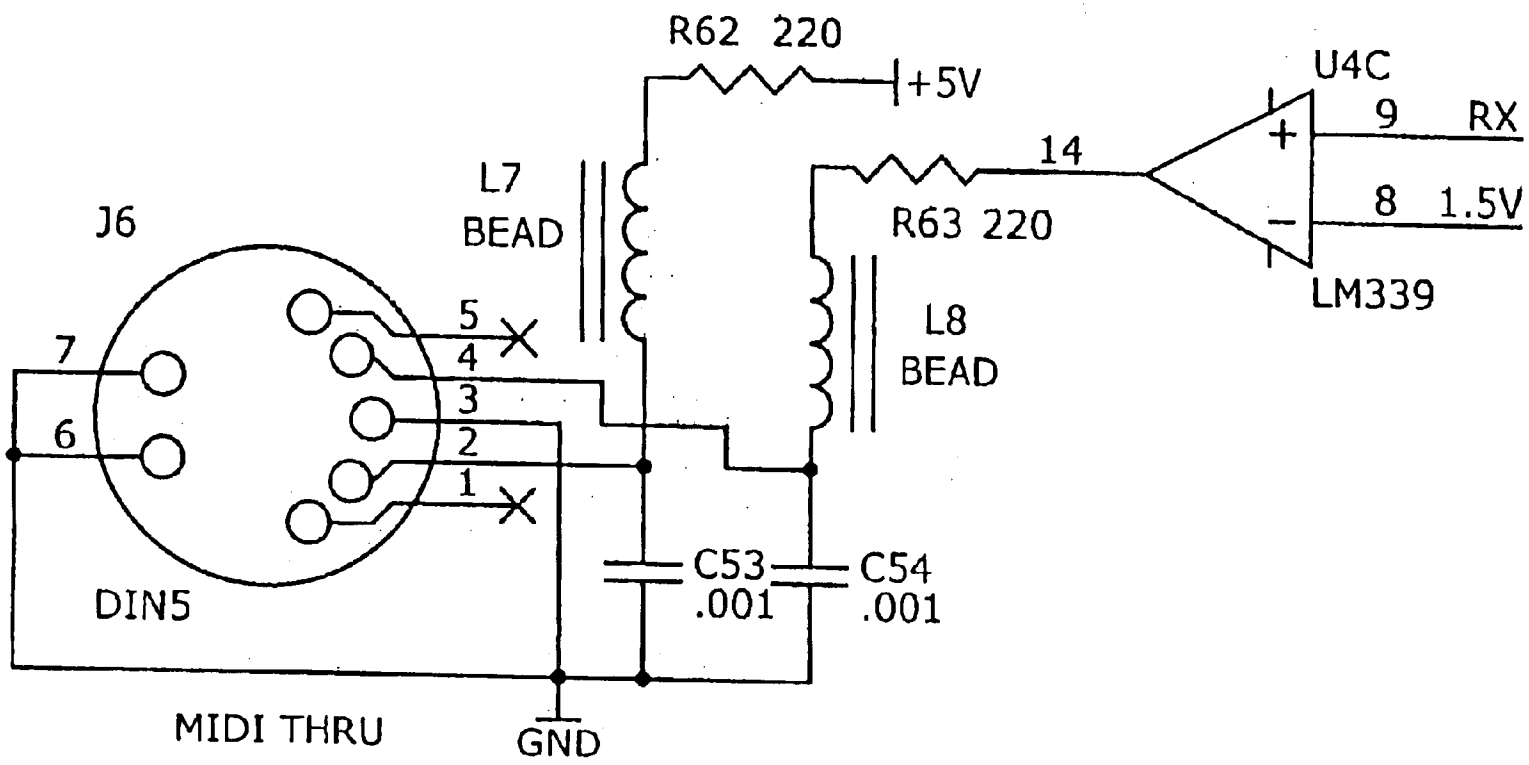
Figure 10D:
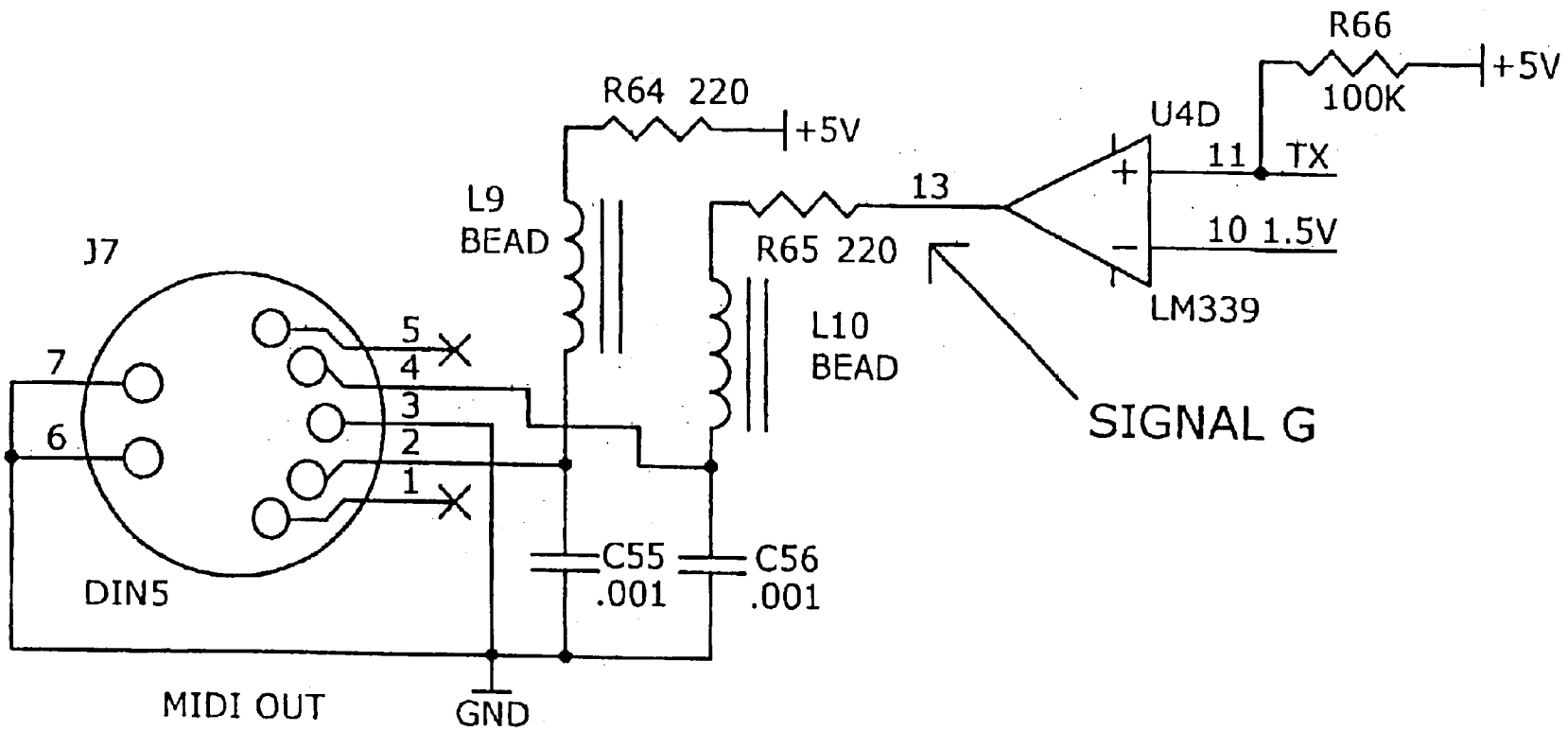
Figure 10E:
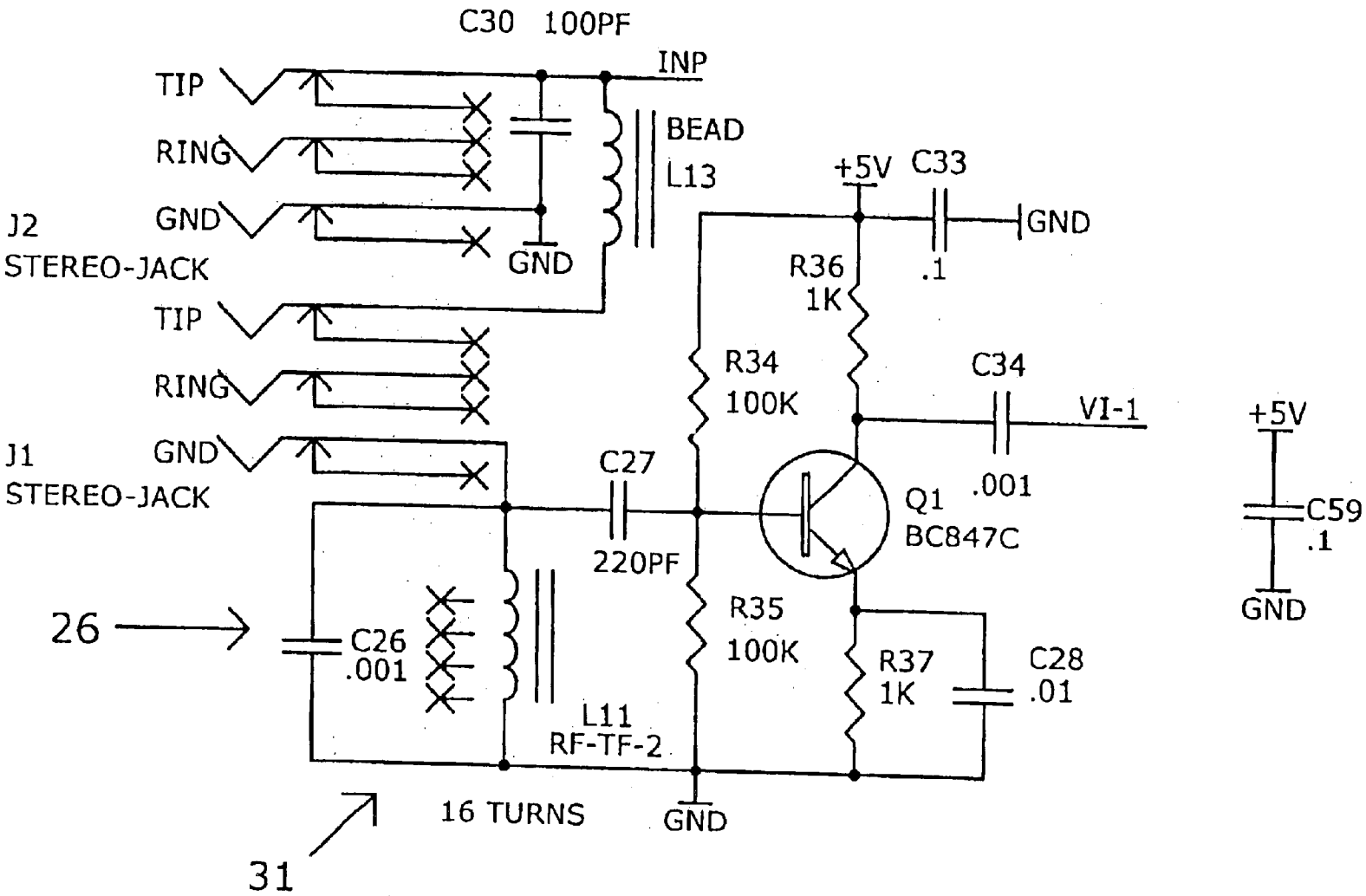
Figure 10F:
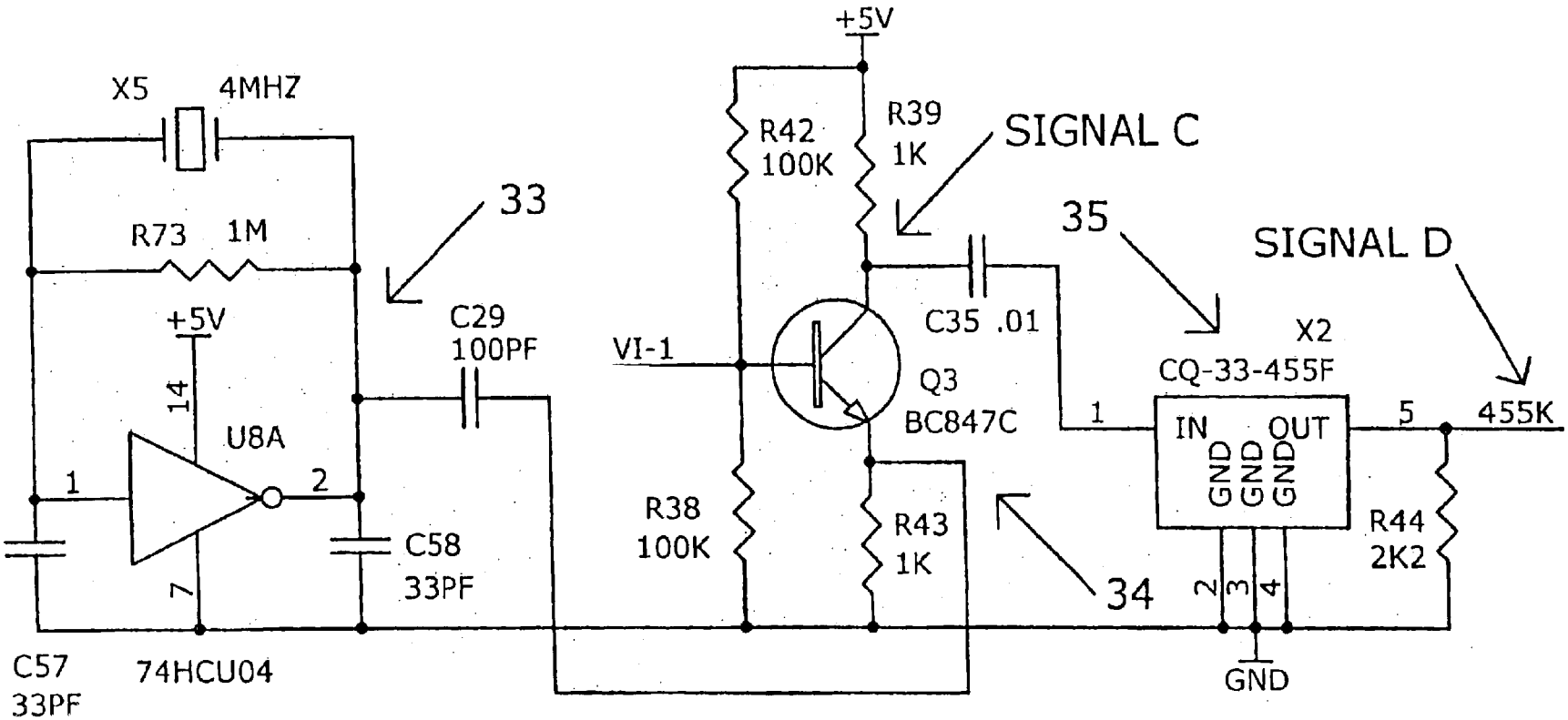
Figure 10G:
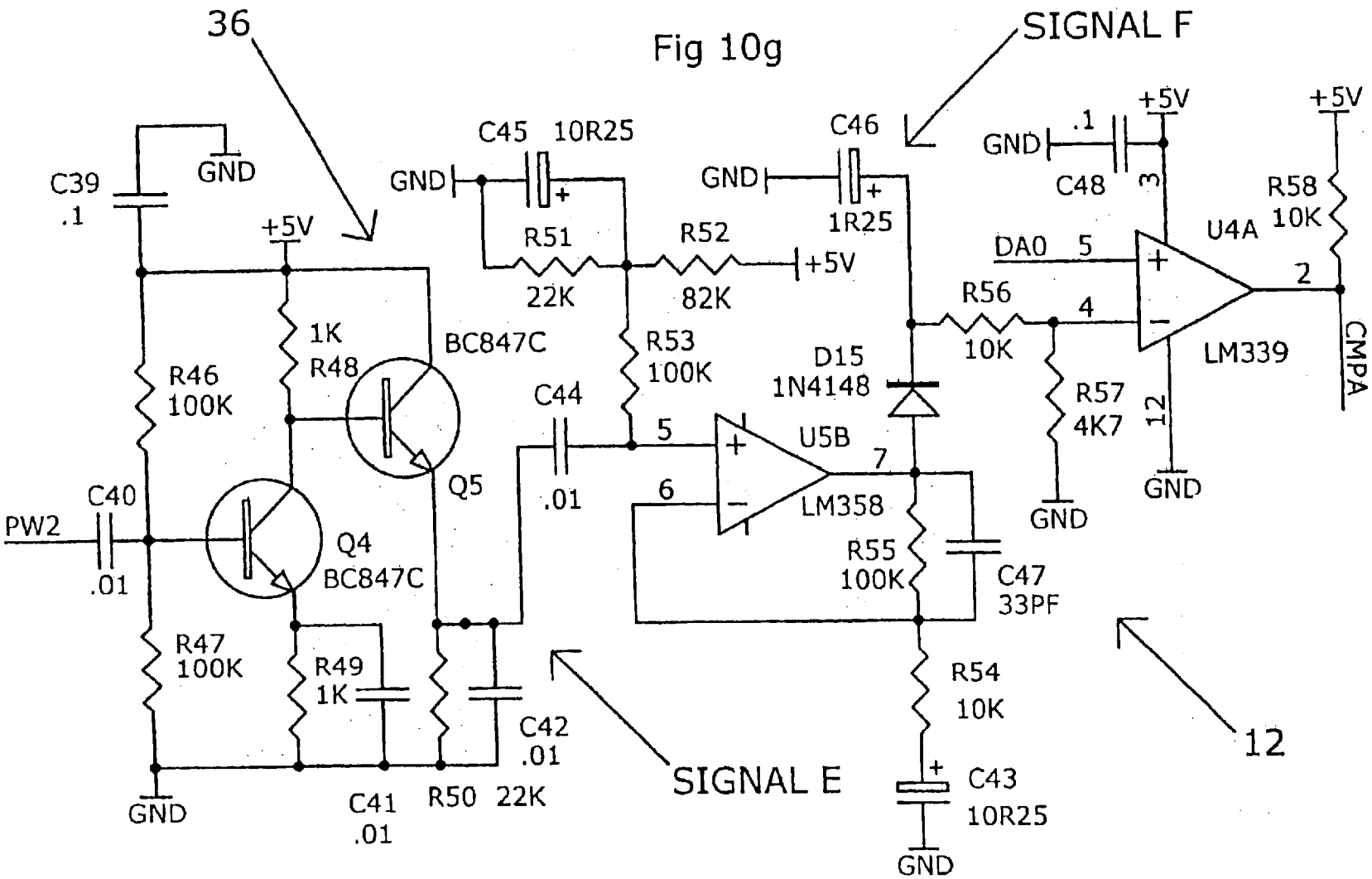
Figure 10H:
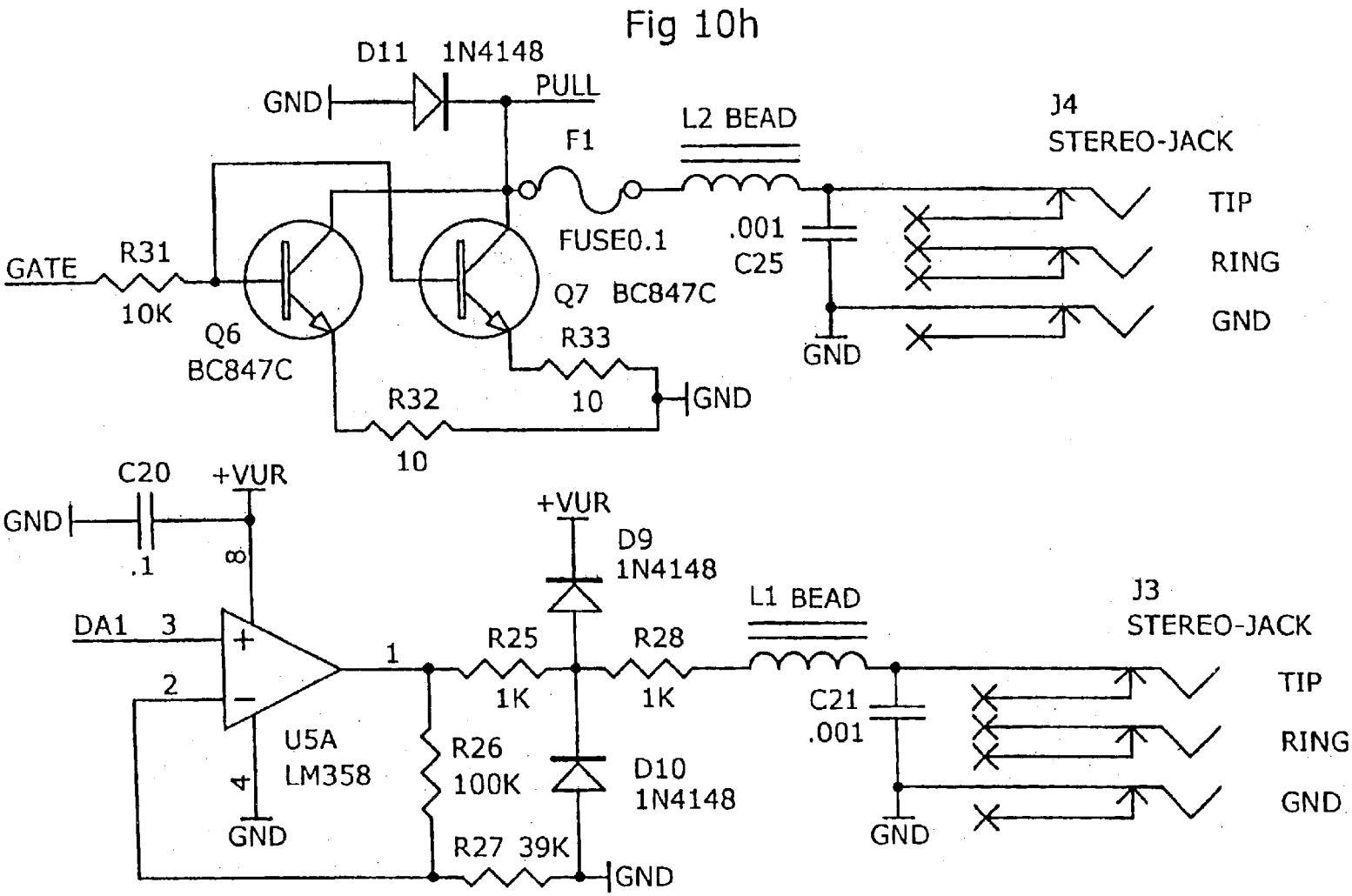
Figure 10I:
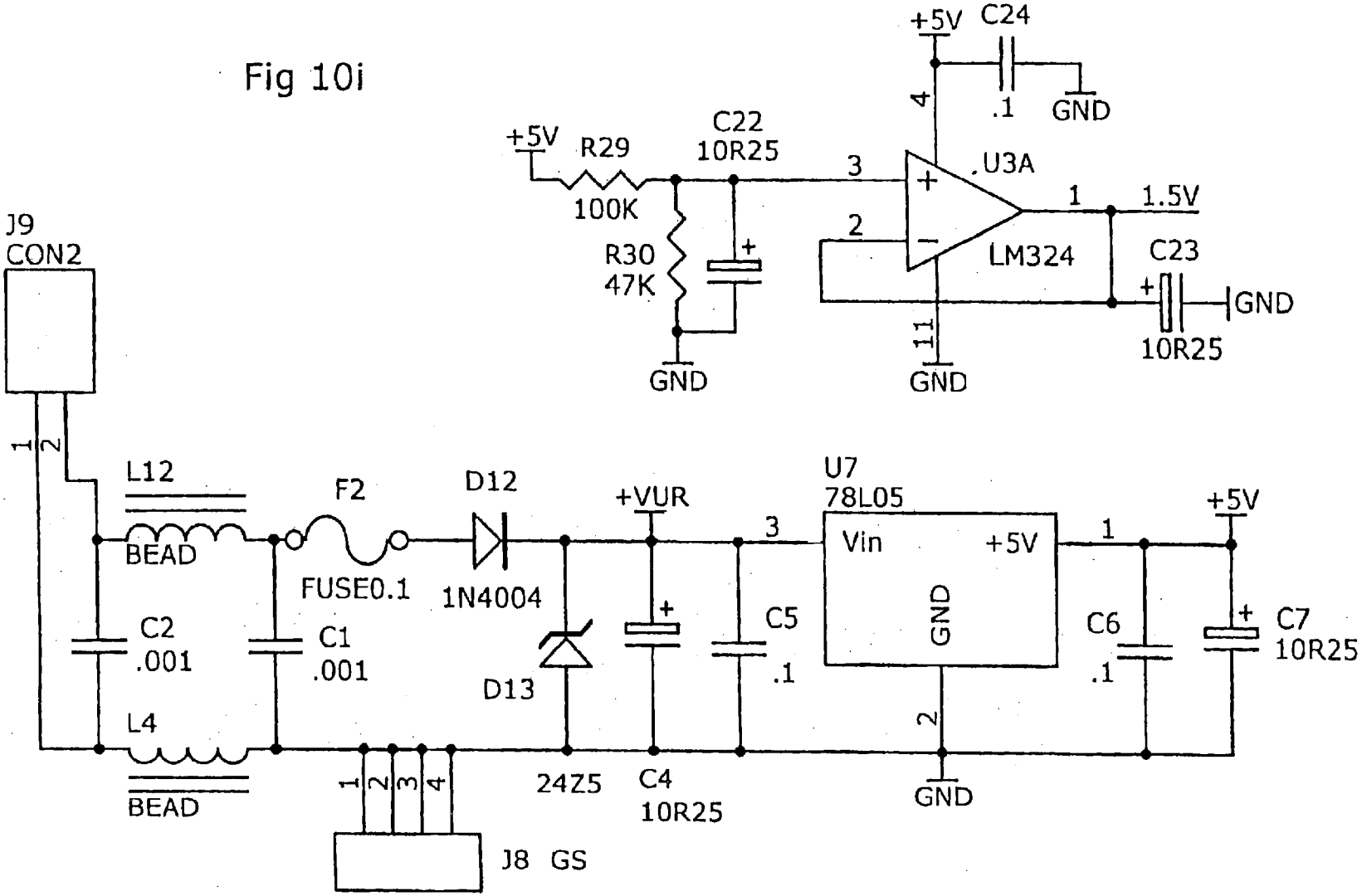
Figure 10J:
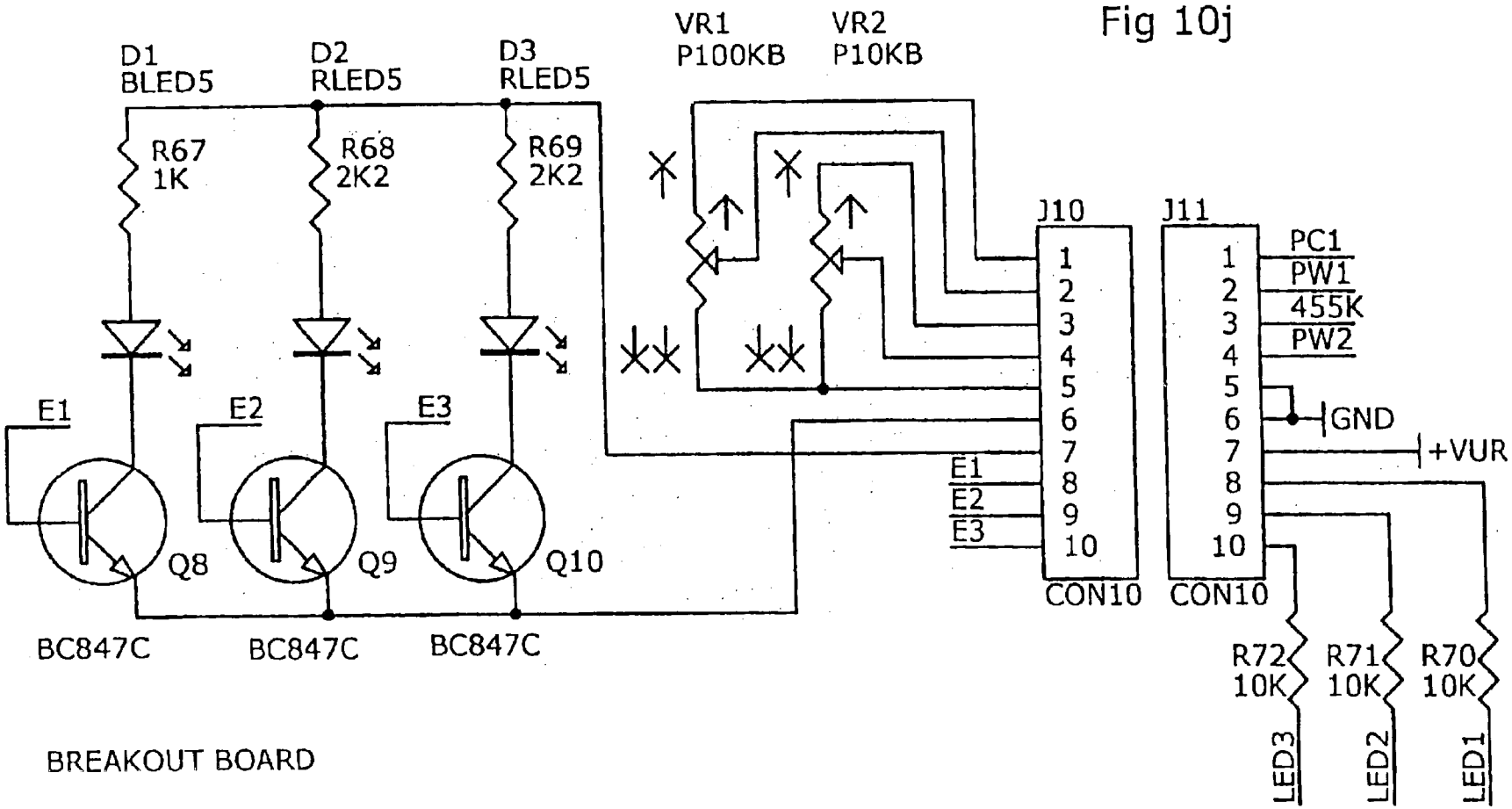
Figure 10K:
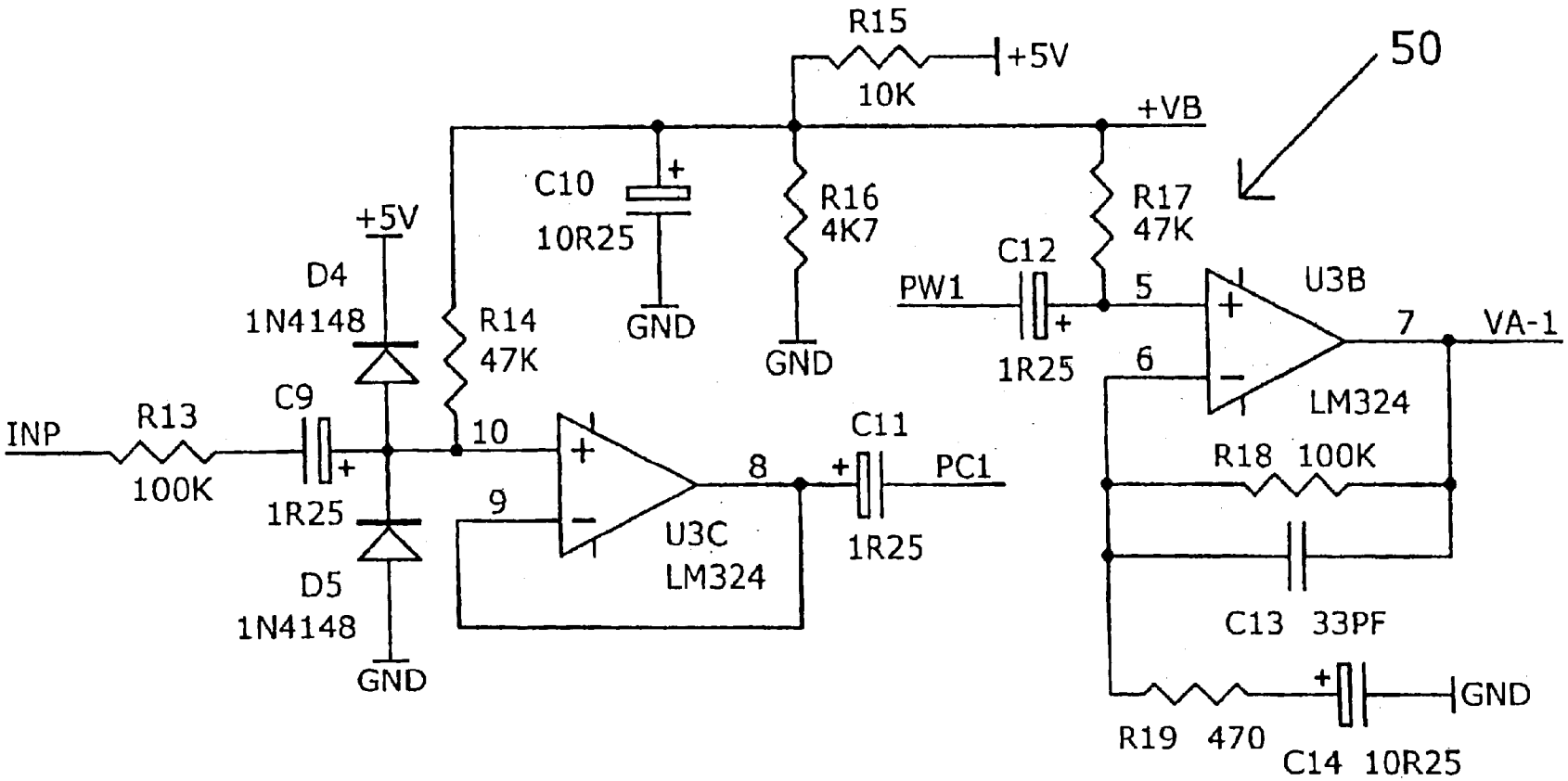
Figure 10L:
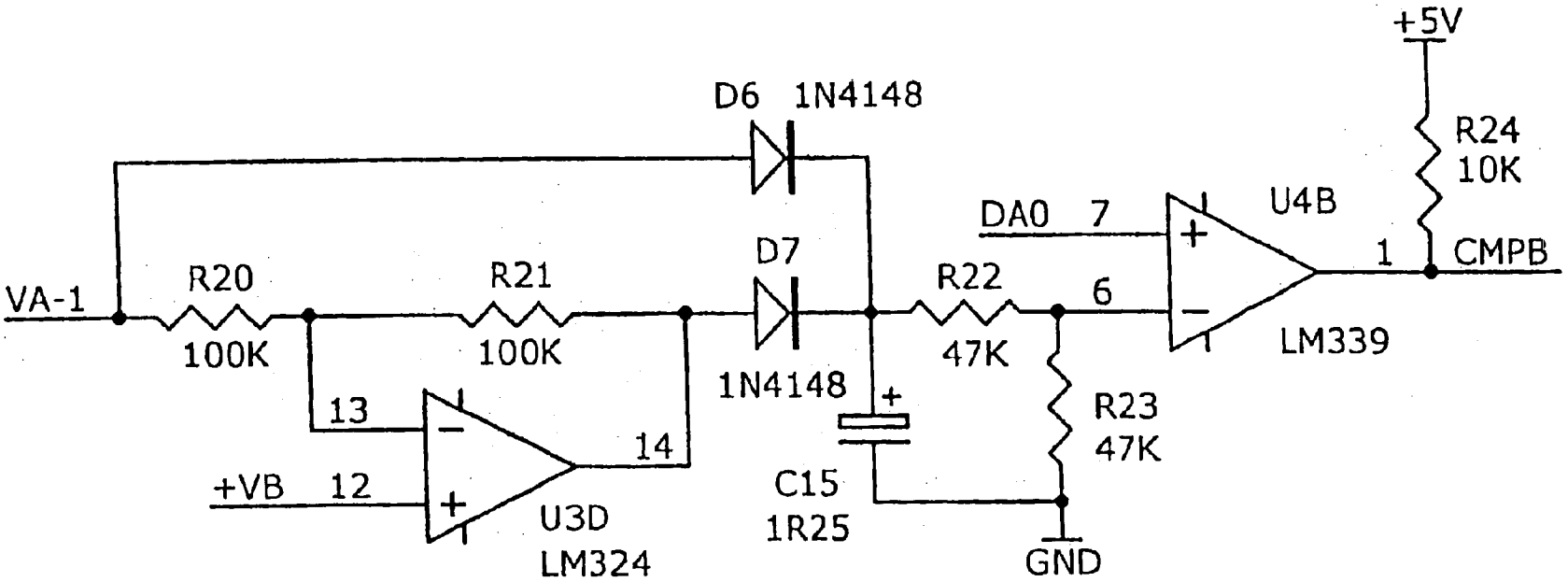

As illustrated in FIG. 9, the transmitter circuitry of the preferred embodiment makes radio frequency grounding connections labelled RGND or +3V. This may be achieved by allowing one of the terminal connections of the battery to make direct connection with the skin of a user. Such a radio frequency ground connection has been found by the inventor to provide a significantly stronger signal, if such is desired.

The strings 10 of the instrument 11 are electrically connected to an instrument-ground 29, which is, in turn, electrically connected to the receiver 24, and in particular to the receiver circuitry 26. The instrument-ground 29 is normally included as a part of the audio cable.

The radio frequency generator 25 is capable of producing a signal A as shown in FIG. 11. This signal is a waveform at a carrier frequency which preferably lies within the range of 100 KHz to 30MHz, and in the preferred embodiment is 3.545 MHz.

Figure 15:
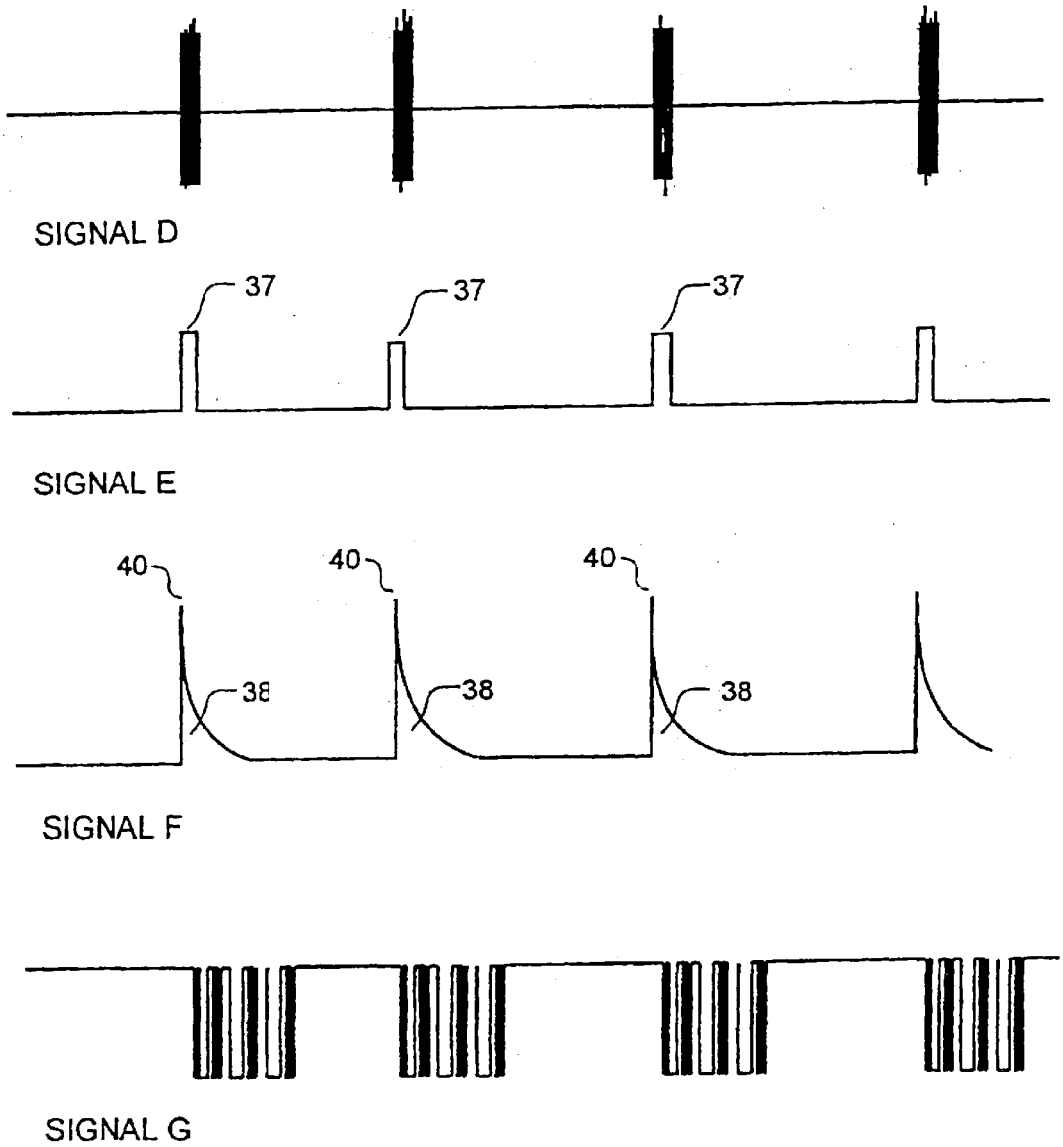

As best shown in FIG. 6, the instrument-ground 29 is electrically connected to the receiver-ground 30, the connection 31 effectively forming an electrical short between the grounds 29 and 30 at audio frequencies such as those generated by the instrument 11, however the connection 31 also effectively forms a first tuned receiver between the grounds 29 and 30, the tuned receiver being broadly tuned at the carrier frequency. The connection 31 is an inductor (labelled L1 in FIG. 6 and labelled L11 in FIG. 10) and a capacitor (labelled C1 in FIG. 6 and C26 in FIG. 10) wired in parallel between the instrument-ground 29 and the receiver-ground 30. The 3.545 MHz radio frequency that is coupled into the resonate circuit 31 appears as a voltage at connection 29, this voltage is illustrated in FIG. 12 signal B. Signal B is coupled through the capacitor C27 into the amplifier circuitry 28 which is comprised of Q1, R34, R35, R36, R37 and C23. This 3.545 MHz amplified signal is then coupled through C22 onto the base of transistor Q3 which forms a non-linear mixer along with R42, R38, R39, and R43, circuitry 34. A 4.00 MHz local oscillator signal is generated from circuitry 33. This circuitry comprises U8, C57, C58, R73 and X5. Such an arrangement allows the local oscillator frequency to be easily changed by using a different frequency crystal X5, along with a corresponding change to the frequency of the transmitter. Such a change may become necessary if two identical preferred embodiments are operating at close quarters and interfering with each other. The output (U5 pin 2) is coupled onto the emitter of Q3 through the capacitor C34. The resulting Signal C as appears on the collector of Q3 has a frequency component that is equal to the difference between the 3.545 MHz carrier frequency and the 4.00 MHz local oscillator. This difference is known as the intermediate frequency and in the preferred embodiment is a waveform having a 455 KHz component as shown in FIG. 13. The amplitude of the 455 KHz frequency component is directly proportional to the amplitude of the 3.545 MHz carrier radio frequency. The band pass filter as described next selectively passes only the 455 KHz frequency so in effect the circuitry has selectivity for the frequency of 3.545 MHz. This helps in the rejection of broad spectrum noise which could potentially interfere with the operation of the device. This technique is known as a superheterodyne receiver. This gives Signal C as shown in FIG. 13. Signal C is then passed through a selective band pass filter 35 tuned at the intermediate frequency. In the preferred embodiment, the selective band pass filter 35 is comprised of a ceramic resonator labelled X2 in FIG. 10. The output of the selective band pass filter 35 is signal D as shown in FIG. 14. Signal D is present in the electronic monitoring circuit only when the tip 8 of the plectrum 4 is in contact with the string 10. This is shown in FIG. 15 where intermittent bursts of signal D are shown.

The signal is then amplified by Q4 as shown in FIG. 10. The degree of amplification is varied by potentiometer VR2.

This allows the user to adjust the signal strength, which affects the sensitivity of the system to outside interference. If the gain is too low the system may miss triggers, however if it is too high false triggers may be caused by outside electromagnetic interference.

The signal is then passed through a detector circuit 36 which is made up of Q5, R50 & C42 as also shown in FIG. 10. The output of Q5 is the envelope of the intermediate frequency component which is proportional to the radio frequency signal. This is shown as signal E in FIG. 15. The envelope has brief pulses 37 which substantially correspond to the period of time for which the plectrum tip 8 is in contact with the string 10. This signal is then AC coupled and amplified by U58 as shown in FIG. 10. The brief pulses 37 are then time-stretched so as to provide a modified signal (signal F shown in FIG. 15) having time-stretched pulses 38 which, because of their longer duration, are not missed by the microprocessor to which the signal is subsequently fed. The time-stretching of the pulses 37 is performed by D15, C45, R54 and R57 as shown in FIG. 10.

Figure 8:
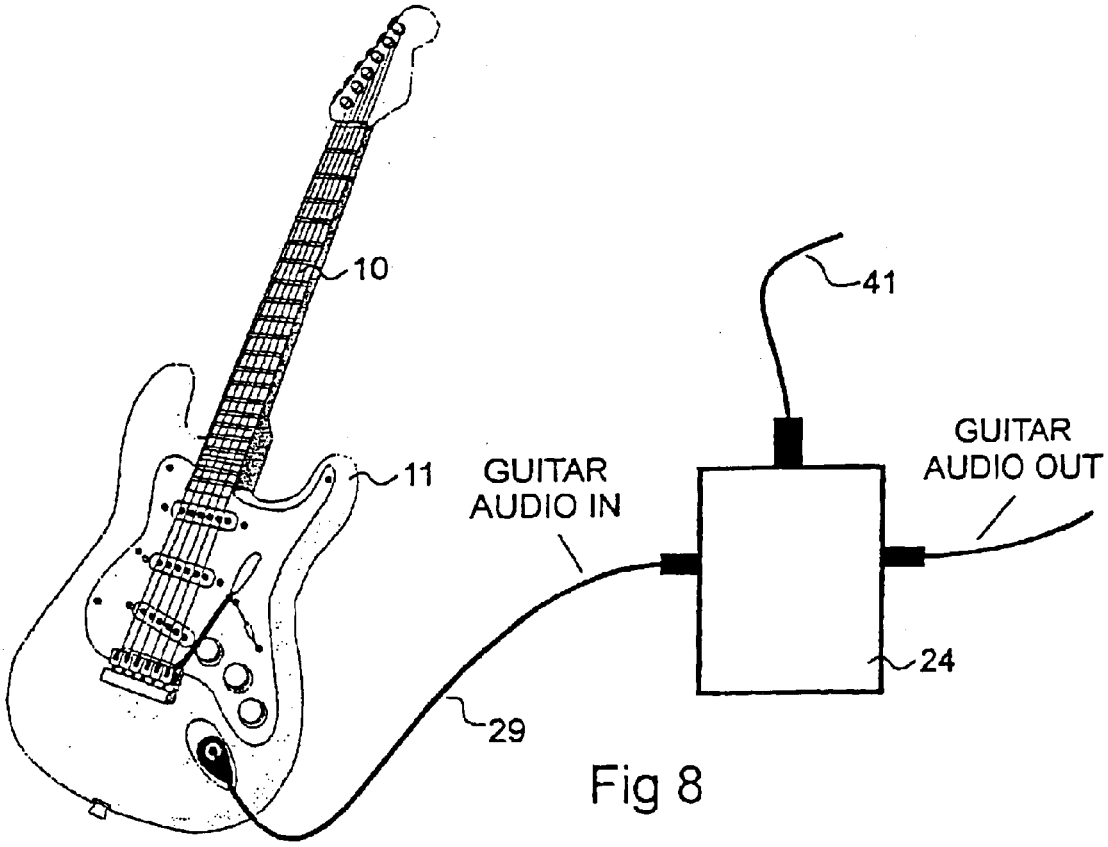
FIG. 8 is a part-perspective, part-schematic view of a receiver according to the present invention, the receiver being electrically connected to a string instrument.

The electronic monitoring circuitry 12 includes a microprocessor 39 adapted to receive said modified signal (signal F) and to perform an analogue-to-digital conversion thereto using U2 so as to produce a digital representation of signal F. The microprocessor 39 is further adapted to detect positive transients 40 in the digital version of the signal and to generate a triggering signal (signal G) by correlating each of the positive transients 40 with an initial contact of the plectrum tip 8 with the string 10. In other words, each time the plectrum tip 8 initially makes conductive contact with the string 10, instantaneously before the moment of plucking, the electronic monitoring circuitry is adapted to output a triggering signal responsive to said contact. The triggering signal (signal G) provided by one preferred embodiment of the invention is of the MIDI (Musical Instrument Digital Interface) type. An alternative embodiment outputs a triggering signal consisting of a control voltage and a gate signal (this alternative triggering signal is not illustrated). The triggering signal is fed from the receiver 24 via triggering cable 41 as shown in FIG. 8.

Put simply, when a transient 40 of sufficient amplitude is detected, a pick event is deemed to have happened and the associated controlled signals are then generated to provide a triggering signal.

The audio signal (not illustrated) generated by the instrument 11 is applied to amplifier U3C via resistor R13 as shown in FIG. 10. This circuitry 50 is adapted to store maximum amplitudes of the audio signal from the instrument 11. In other words, each time a string 10 of the instrument 11 is plucked, the receiver circuitry stores a maximum amplitude of the resulting audio signal. The circuitry of U3B, U3D, D4, D7 and C15 (as indicated on FIG. 10) holds said maximum amplitude. The electronic monitoring circuitry 12 includes a microprocessor 39 (which may be the same microprocessor mentioned previously, or may be a separate microprocessor) which is adapted to measure the stored amplitude and to output a value corresponding to the amplitude. In some embodiments this value is digital and in other embodiments it is analogue. The value is effectively an output corresponding to the force with which the string 10 is plucked. This information can be transmitted to an audio effects system so that effects can respond to the intensity with which a string 10 is plucked. In some embodiments, the electronic monitoring circuitry 12 and the receiver circuitry 50 are adapted to measure and record the maximum amplitude of the audio signal each time the tip 8 contacts a string 10. In other embodiments, circuitry 12 and 50 is adapted to measure the maximum amplitudes occurring during predefined time intervals.

Figure 17:
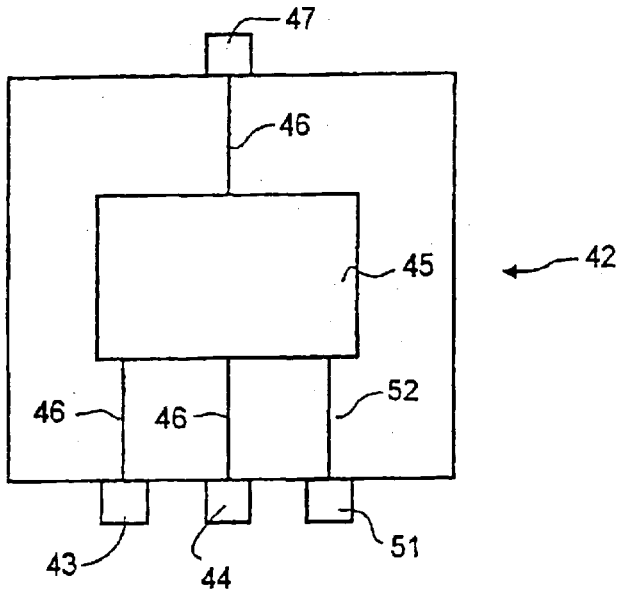
FIG. 17 is a schematic view of a signal processing apparatus according to the present invention.

With reference to FIG. 17. the signal processing apparatus 42 processes the audio signal derived from the string instrument 11. In some preferred embodiments all signal processing is performed digitally, in other preferred embodiments the signal processing may be exclusively analogue, or a combination of digital and analogue. The signal processing apparatus 42 is adapted to function in conjunction with the plectrum of the present invention. The apparatus 42 includes a first input 43 to receive the audio signal from the string instrument 11. The second input 44 receives the triggering signal (signal G) which includes a plurality of triggering pulses, each indicative of a plucking of any of the strings 10 by the plectrum tip 8. The apparatus 42 houses signal processing circuitry 45 which is adapted to perform a plurality of different processes, each process modifying the audio signal. For example, some of the processes may be relatively straight forward modifications to provide effects such as echo, reverberation, phasing, panning, chorus and flanging. However more sophisticated and elaborate processes may be provided by altering one more parameter values and/or one or more effects algorithms which are, in turn, used by the signal processing circuitry 45 to modify the audio signal. The signal processing circuitry 45 is electrically connected via wires 46 to the first and second inputs respectively, 43 and 44. The signal processing circuitry 45 is adapted to vary the particular process used to modify the audio signal according to a predefined relationship with the triggering signal. In other words, the signal processing circuitry 45 has a number of different processes or "effects", which can be varied based upon the triggering signal. The apparatus 42 also includes an output 47 electrically connected to the digital signal processing circuitry 45 via wire 46 for outputting the modified audio signal (not illustrated).

The predefined relationship between the triggering signal and the varying of the particular process used to modify the audio signal can be adjusted as required. For example, in one embodiment, the particular process used to modify the audio signal is varied each time an integral number of triggering pulses are received. In another embodiment, the integral number is 1, meaning that the particular process used to modify the audio signal is varied each time a triggering pulse is received by the signal processing circuitry 45. This is shown schematically in FIG. 16. It would be appreciated by those skilled in the art, however, that other predefined relationships may be used for example making a first variation to the particular process after a first number of triggering pulses are received, followed by a second variation to the particular process after a second number of triggering pulses are received, and so on.

Figure 16:
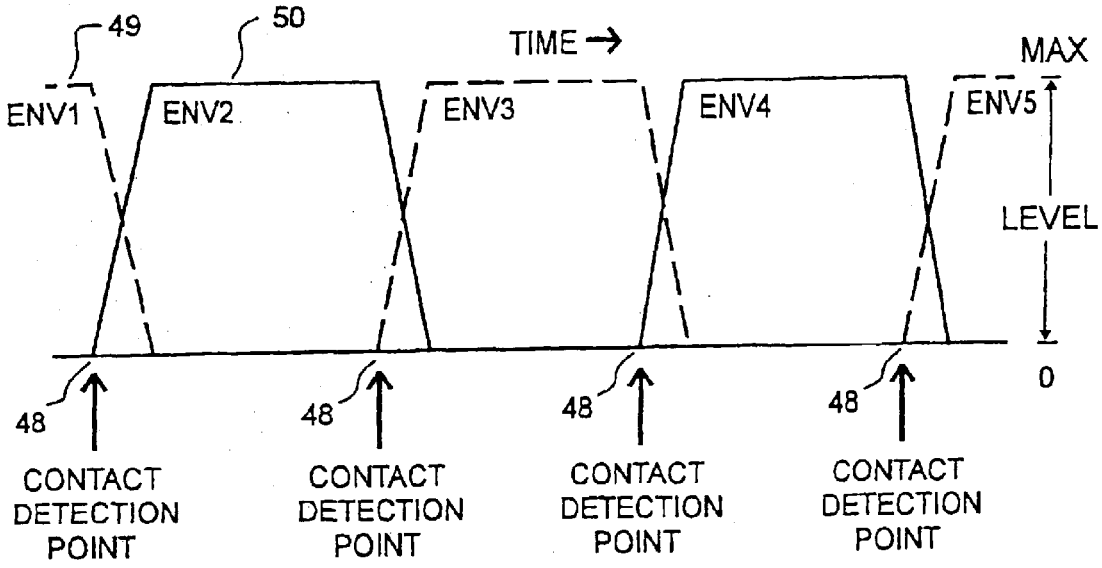
FIG. 16 is a schematic diagram illustrating the transition between various events in a signal processing apparatus according to the invention.

During the transition from a first process to a second process, the first process is progressively faded out and the second process is simultaneously progressively faded in. This transitional arrangement is illustrated in FIG. 16 where the horizontal axis represents time and the vertical axis represents the degree to which a particular process is used to modify the audio signal. At the time when a triggering pulse is received 48, the degree to which the first process 49 is applied to the audio signal begins to decrease and, simultaneously, the degree to which the second process 50 is applied to the audio signal is increased. This provides a smooth transition between processes. As can be seen in FIG. 16, the same fade-in, fade-out technique is used each time a subsequent variation of a process is made. The transition commences upon receipt of a triggering pulse such that each transition is initiated substantially at each moment the tip 8 first contacts the plectrum during plucking. As described above, triggering from the moment of initial contact (rather than the moment of which contact is broken as in the prior art) advantageously provides a brief lead-in time before the string 10 of the instrument 11 is actually plucked. This enables any delay that may be introduced by the signal processing circuitry 45 to be off-set against the "head start" provided by the triggering signal.

The preferred embodiment of the signal processing apparatus 42 includes provision for at least one of the operative characteristics of one or more of said processes to be variable dependent upon the maximum amplitude of the audio signal each time the plectrum 4 contacts a string 10. The signal processing apparatus 42 includes a third input 51 to receive a value indicative of a maximum amplitude of the audio signal from the microprocessor 39. The third input 51 is adapted to feed the value to the signal processing circuitry 35 via a wire 52. The operative characteristics of the processes which may be varied include factors such as the parameters and/or the algorithms used to modify the audio signal. In some embodiments, the function of the second and third inputs, 44 and 51, is performed by a single input (not illustrated) which is adapted to receive and de-code an information stream having information relating to both the triggering and the maximum amplitude.

Although the invention has been described with reference to specific examples, it will be appreciated by those skilled in the art that the invention may be embodied in many other forms.

What is claimed is:

1. A plectrum for a string instrument having a plurality of conductive strings, said plectrum including:

a non-conductive body defining a gripping portion and a plucking portion; and a conductive tip of unitary construction protruding by no more than 1 mm beyond an edge of said plucking portion, an outer surface of said tip being sized so as to fleetingly contact a string of said instrument when said string is plucked by said plucking portion, said tip further being capable of operative association with electronic monitoring circuitry adapted to provide a triggering signal each time the tip contacts any one of said strings.

2. The plectrum according to claim 1, wherein said tip is electrically connected to a first wire embedded within said body, said first wire being, in turn, electrically connected to a second wire external of said body and extending from a point on said body remote of said plucking portion.

3. The plectrum according to claim 1, wherein a perimeter length of said tip is no longer than 8 mm.

4. The plectrum according to claim 1, wherein a width of said tip is less than a width of said body.

5. The plectrum according to claim 2, wherein said body is generally a triangular shape, a region adjacent a first apex of said triangular shape defining said plucking portion, and a region adjacent the other two apexes defining said gripping portion, said tip being disposed at said first apex.

6. The plectrum according to claim 5, wherein said second wire extends from, or adjacent to, one of said other apexes.

7. The plectrum according to claim 1, wherein an outer edge of said tip is shaped to generally correspond to a shape of said outer edge of said plucking region from which it extends.

8. The plectrum according to claim 1, wherein said electronic monitoring circuitry is adapted to detect the initial contact between the tip and the string and to use said initial contact as the basis for the triggering signal.

9. A signal processing apparatus in combination with a string instrument including a plurality of conductive strings, wherein the string instrument is plucked by a plectrum, said plectrum including;

a non-conductive body defining a gripping portion and a plucking portion; and a conductive tip protruding just beyond an edge of said plucking portion, an outer surface of said tip being sized so as to fleetingly contact a string of said instrument when said string is plucked by said plucking portion, said tip further being capable of operative association with electronic monitoring circuitry adapted to provide a triggering signal each time the tip contacts any one of said strings, wherein said signal processing apparatus is adapted to process an audio signal derived from said string instrument, said apparatus including:

a first input to receive said audio signal;

a second input to receive a triggering signal which includes a plurality of triggering pulses, each indicative of a plucking of any of said strings by said plectrum tip;

signal processing circuitry adapted to perform a plurality of different processes, each process modifying the audio signal, said circuitry being electrically connected to said first and second inputs, and wherein said signal processing circuitry is adapted to vary the particular process used to modify the audio signal according to a predefined relationship with said triggering signal; and an output electrically connected to said signal processing circuitry for outputting a modified audio signal.

10. The signal processing apparatus according to claim 9, wherein said predefined relationship is such that the process is varied each time an integral number of triggering pulses are received by the signal processing circuitry.

11. The signal processing apparatus according to claim 10, wherein said integral number is one.

12. The signal processing apparatus according to claim 9, wherein, during a transition from a first process to a second process, the first process is progressively faded out and the second process is simultaneously progressively faded in.

13. The signal processing apparatus according to claim 12, wherein said transition commences upon receipt of a triggering pulse such that each transition is initiated substantially at each moment the tip first contacts the plectrum during plucking.

14. The signal processing apparatus according to claim 9, wherein at least one of the operative characteristics of one or more of said processes is variable dependent upon a maximum amplitude of the audio signal each time the plectrum contacts a string.

15. The signal processing apparatus according to claim 9, wherein said plectrum communicates with said signal processing apparatus via a transmitter and/or receiver arrangement, said arrangement including a transmitter having a signal generator electrically connectable to said tip such that, when said tip fleetingly connects with said string during plucking, the transmitter produces a signal which is detectable by receiver circuitry, said receiver circuitry being operatively associated with said electronic monitoring circuitry so as to provide said triggering signal.

16. The signal processing apparatus according to claim 14, further comprising a transmitter/receiver arrangement, including a transmitter having a signal generator electrically connectable to said tip such that, when said tip fleetingly connects with said string during plucking, the transmitter produces a signal which is detectable by receiver circuitry, said receiver circuitry being operatively associated with said electronic monitoring circuitry so as to provide said triggering signal;

wherein said receiver circuitry is adapted to store and output a value corresponding to a maximum amplitude of an audio signal from said instrument each time the plectrum contacts the string; and said electronic monitoring circuitry includes a microprocessor adapted to measure the stored value and to output a digital value corresponding to the amplitude, wherein the signal processing apparatus includes a third input to receive said digital value, said third input being adapted to feed said value to the signal processing circuitry.

17. The signal processing apparatus according to claim 16, wherein the second and third inputs comprise a single input which is adapted to receive and decode an information stream having information relating to both the triggering and the maximum amplitude.

18. A transmitter/receiver arrangement adapted for use with a plectrum, said arrangement including a transmitter having a signal generator electrically connectable to a tip of the plectrum such that, when said tip fleetingly connects with a string of a string instrument during plucking, the transmitter produces a signal which is detectable by receiver circuitry, said receiver circuitry being operatively associated with electronic monitoring circuitry so as to provide a triggering signal, wherein said signal generator is a radio frequency signal generator capable of producing a waveform at a carrier frequency, and said receiver circuitry is adapted to compare the carrier frequency with a local oscillator signal so as to only acknowledge a contact between the tip and the string once an intermediate frequency, which is a difference between the carrier frequency and the local oscillator frequency, is detected by the receiver, thereby reducing the likelihood of false triggering due to outside interference from radio frequency noise.

19. The transmitter/receiver arrangement according to claim 18, wherein said electronic monitoring circuitry includes a detector circuit adapted to output an envelope of the intermediate frequency component of the radio frequency signal, said envelope having brief pulses substantially corresponding to the period of time for which the plectrum tip is in contact with the string.

20. The transmitter/receiver arrangement according to claim 19, wherein said brief pulses are time-stretched so as to provide a modified signal having time-stretched pulses which would not be missed by a microprocessor.

21. The transmitter/receiver arrangement according to claim 20, wherein said electronic monitoring circuitry includes a microprocessor adapted to receive said modified signal and perform an analog-to-digital conversion thereto.

22. The transmitter/receiver arrangement according to claim 21, wherein said microprocessor is further adapted to detect positive transients in said modified signal and to generate said triggering signal by correlating each of said positive transients with an initial contact of the plectrum tip with the string.

23. The transmitter/receiver arrangement according to claim 18, wherein said receiver circuitry is adapted to store and output a value corresponding to a maximum amplitude of an audio signal from said instrument each time the plectrum contacts the string.

24. The transmitter/receiver arrangement according to claim 23, wherein said electronic monitoring circuitry includes a microprocessor adapted to measure the stored value and to output a digital value corresponding to the amplitude.

25. The transmitter/receiver arrangement according to claim 18, wherein both said carrier frequency and a frequency of said local oscillator signal are within the range 100 KHz to 30 MHz.

26. The transmitter/receiver arrangement according to claim 18, wherein said instrument-ground is electrically connected to a receiver-ground, said connection effectively forming an electrical short between said grounds at audio frequencies, and a first tuned receiver between said grounds which is broadly tuned at said carrier frequency.

27. The transmitter/receiver arrangement according to claim 25, wherein said connection is an inductor and a capacitor wired in parallel between the instrument-ground and the receiver-ground.

28. The transmitter/receiver arrangement according to claim 26, wherein, after passing through said connection, the radio frequency signal is amplified.

29. The transmitter/receiver arrangement according to claim 26, wherein said receiver circuitry includes a selective band pass filter tuned at the intermediate frequency.

30. The transmitter/receiver arrangement according to claim 28, wherein said local oscillator signal is derived from a clock circuit of a microprocessor or from a frequency crystal.

* * * * *